US009863137B2

(12) United States Patent
Knoblauch et al.

(10) Patent No.: US 9,863,137 B2
(45) **Date of Patent: *Jan. 9, 2018**

(54) THERMAL BREAK FOR USE IN CONSTRUCTION

(71) Applicant: JK Worldwide Enterprises Inc., Surrey (CA)

(72) Inventors: Jeffrey S. Knoblauch, Langley (CA); Jared D. Krish, Langley (CA)

(73) Assignee: JK Worldwide Enterprises Inc., Surrey (CA)

( * ) Notice: Subject to any disclaimer, the term of this patent is extended or adjusted under 35 U.S.C. 154(b) by 0 days.

This patent is subject to a terminal disclaimer.

(21) Appl. No.: 15/262,965

(22) Filed: Sep. 12, 2016

(65) Prior Publication Data

US 2017/0067245 A1 Mar. 9, 2017

Related U.S. Application Data

(63) Continuation-in-part of application No. 14/835,296, filed on Aug. 25, 2015, now Pat. No. 9,598,891.

(Continued)

(51) Int. Cl.
*E04B 1/35* (2006.01)
*E04C 2/284* (2006.01)

(Continued)

(52) U.S. Cl.
CPC ..... *E04B 1/355* (2013.01); *E04B 1/78* (2013.01); *E04C 2/284* (2013.01); *E04C 2/34* (2013.01);

(Continued)

(58) Field of Classification Search
CPC .... E04B 1/4178; E04B 1/7616; E04B 1/4185; E04B 1/7637; E04B 1/7165; E04B 2001/7679; E04C 2/284

(Continued)

(56) References Cited

U.S. PATENT DOCUMENTS 2,800,743 A * 7/1957 Meehan ..... A63H 33/084 446/127
3,324,615 A * 6/1967 Zinn ..... E04B 2/7409 52/241

(Continued)

FOREIGN PATENT DOCUMENTS

CA 1312441 1/1993
CA WO 2016149822 A1 * 9/2016 ..... E04B 1/78
WO 2016149822 A1 9/2016

OTHER PUBLICATIONS

Building Science Corporation, "BSI-059: Slab Happy—Concrete Engineering", Apr. 15, 2012, 9 pages.

(Continued)

*Primary Examiner* — Rodney Mintz
(74) *Attorney, Agent, or Firm* — Greer, Burns & Crain, Ltd.; Steven P. Fallon

(57) ABSTRACT

The present disclosure relates to an exterior wall for tilt-up construction comprising: (a) a fascia wythe; (b) a structural wythe; (c) a layer of insulating material disposed between the fascia wythe and the structural wythe; and (d) a thermal break in contact with at least the structural wythe, the thermal break comprising an elongate body comprising one or more thermal insulating materials, a first surface suitable for mounting a fixture, a second surface opposite the first surface, a first contacting surface, and a second contacting surface opposite the first contacting surface, the first contacting surface and the second contacting surface extending between the first surface and the second surface. The elongate body is substantially made of a non-wood material, and the structural wythe contacts at least a portion of the second contacting surface. The present disclosure further relates to methods of constructing an exterior wall comprising a thermal break.

13 Claims, 31 Drawing Sheets

Related U.S. Application Data

(60) Provisional application No. 62/136,887, filed on Mar. 23, 2015, provisional application No. 62/146,487, filed on Apr. 13, 2015.

(51) Int. Cl.

| | |
|---|---|
| ***E04B 1/78*** | (2006.01) |
| ***E04C 2/34*** | (2006.01) |
| ***E04B 2/00*** | (2006.01) |
| ***E06B 1/02*** | (2006.01) |
| *E04B 2/02* | (2006.01) |
| *B28B 7/08* | (2006.01) |
| *E04B 1/76* | (2006.01) |
| *E06B 1/00* | (2006.01) |

(52) U.S. Cl.
CPC ..... *E04C 2/46* (2013.01); *E06B 1/02* (2013.01); *B28B 7/08* (2013.01); *E04B 2001/7679* (2013.01); *E04B 2002/0256* (2013.01); *E04B 2002/0282* (2013.01); *E06B 1/003* (2013.01)

(58) Field of Classification Search
USPC ..... 52/27, 309.12, 364, 782.1, 434, 435, 52/424–426, 404.1, 413, 309.11, 309.7, 52/410
See application file for complete search history.

(56) References Cited

U.S. PATENT DOCUMENTS 3,530,632 A * 9/1970 Sloan ..... B28B 19/0053 52/425
3,618,279 A * 11/1971 Sease ..... E04B 2/46 52/223.7
3,768,225 A * 10/1973 Sloan ..... E04C 2/041 52/425
4,624,089 A 11/1986 Dunker
5,092,092 A * 3/1992 Kiekens ..... E04B 1/7612 52/404.1
5,230,195 A * 7/1993 Sease ..... E04B 2/18 52/309.9
5,493,816 A * 2/1996 Willemsen ..... A63H 33/04 446/104
5,661,874 A * 9/1997 Latour ..... A47G 27/0462 16/16
5,694,723 A * 12/1997 Parker ..... E04B 1/7023 404/4
5,771,643 A * 6/1998 Parker ..... E04B 1/7023 404/8
5,934,037 A * 8/1999 Bundra ..... E04B 2/08 52/126.4
6,050,873 A * 4/2000 Reisman ..... A63H 33/062 446/121
6,164,035 A * 12/2000 Roberts ..... E04B 1/14 52/220.2
6,662,518 B1 * 12/2003 Devereux ..... A47G 27/045 16/16
7,096,630 B1 * 8/2006 Keene ..... E04F 15/20 52/302.1
7,461,490 B2 * 12/2008 Toledo ..... E04B 2/14 52/293.2
7,938,379 B2 * 5/2011 Baten ..... F16M 5/00 248/674
8,011,144 B2 * 9/2011 Compton ..... E02D 27/02 249/2
8,176,697 B1 * 5/2012 Bolander, II ..... E04B 1/4157 52/309.12
8,382,398 B2 * 2/2013 Stauffacher ..... E02B 3/108 405/111
8,516,761 B2 * 8/2013 Laiho ..... E01C 11/08 404/59
8,844,227 B1 9/2014 Ciuperca
8,950,154 B1 * 2/2015 Casey ..... E02D 27/00 49/483.1
8,956,084 B2 * 2/2015 Kelly, Jr. ..... E02D 29/0225 405/262
9,089,096 B1 * 7/2015 Ulrich ..... A01G 1/08
9,598,891 B2 * 3/2017 Knoblauch ..... E04B 1/78
2004/0088947 A1 * 5/2004 Villani ..... E04C 2/049 52/782.1
2006/0059824 A1 * 3/2006 Barbisch ..... E02D 29/025 52/503
2006/0283102 A1 * 12/2006 Sourlis ..... E04B 1/7061 52/62
2007/0193215 A1 * 8/2007 Jablonka ..... E04B 1/70 52/782.1
2008/0060291 A1 * 3/2008 Braun ..... E04C 5/165 52/223.2
2008/0127584 A1 * 6/2008 Schiffmann ..... B29C 70/443 52/293.3
2008/0245007 A1 * 10/2008 McDonald ..... E04C 2/246 52/309.5
2009/0094917 A1 * 4/2009 McIntosh ..... E02D 29/0241 52/311.1
2009/0158675 A1 * 6/2009 Sourlis ..... E04B 1/72 52/101
2009/0308008 A1 * 12/2009 Shockey ..... B29C 33/424 52/309.12
2010/0101168 A1 * 4/2010 Hohmann, Jr. ..... E04B 1/7046 52/513
2010/0107531 A1 * 5/2010 Hunsaker ..... E04F 13/147 52/314
2010/0311299 A1 * 12/2010 Rath ..... A63H 33/14 446/87
2011/0016817 A1 * 1/2011 Way ..... E04B 1/163 52/426
2011/0021107 A1 * 1/2011 Nag ..... A63H 33/042 446/91
2011/0258964 A1 * 10/2011 Wu ..... E04B 1/14 52/791.1
2011/0271624 A1 * 11/2011 Wilson ..... E04F 13/0864 52/309.4
2011/0289877 A1 * 12/2011 Correia ..... E04F 13/0851 52/309.4
2012/0023858 A1 * 2/2012 Lee ..... E04C 5/0645 52/636
2012/0055010 A1 * 3/2012 Milburn ..... E06B 3/66342 29/527.1
2012/0144765 A1 * 6/2012 LeBlang ..... E04B 2/58 52/220.2
2012/0240496 A1 * 9/2012 Gutzwiller ..... E04B 5/43 52/223.1
2012/0261053 A1 * 10/2012 O'Leary ..... B29C 44/185 156/79
2013/0312357 A1 * 11/2013 Lin ..... A63H 33/106 52/589.1
2014/0087158 A1 3/2014 Ciuperca
2014/0182221 A1 * 7/2014 Hicks ..... E02D 31/00 52/169.11
2016/0281413 A1 * 9/2016 Knoblauch ..... E04B 1/78
2016/0312459 A1 * 10/2016 Hochstuhl ..... E04B 1/41
2016/0312460 A1 * 10/2016 Hochstuhl ..... E04B 1/41
2017/0022682 A1 * 1/2017 Hicks ..... E02D 31/00
2017/0159348 A1 * 6/2017 Knoblauch ..... E06B 1/02

OTHER PUBLICATIONS

JK Thermal Solutions, "TigerLoc Installation Guide", Jan. 16, 2016, 7 pages.
Schoeck Isokorb, "Thermal Bridge Solutions Product Guide—North America", Jan. 2013, 12 pages.
Thermomass System NC, "Canopy Connection", Dec. 16, 2010, 1 page.
Thermomass System NC, "Canopy Connection—Slotted", Dec. 16, 2010, 1 page.

(56) References Cited

OTHER PUBLICATIONS

Search Report and Written Opinion for PCT/CA2016/050335 dated Jun. 23, 2016 (8 pages).

* cited by examiner

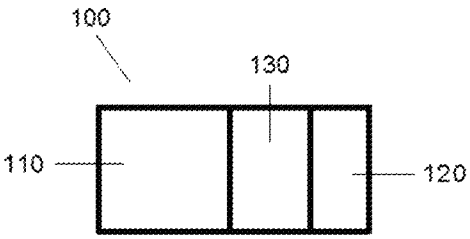
FIGURE 1(a) – Prior Art
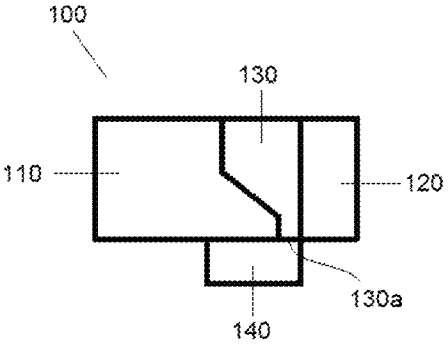
FIGURE 1(b) – Prior Art
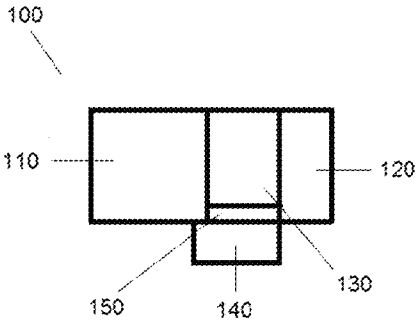
FIGURE 1(c) – Prior Art

THERMAL BREAK FOR USE IN CONSTRUCTION

RELATED CASES

This application is a continuation-in-part of application Ser. No. 14/835,296, filed on Aug. 25, 2015, which claims the benefit of provisional application 62/136,887, filed on Mar. 23, 2015, and provisional application 62/146,487, filed on Apr. 13, 2015.

TECHNICAL FIELD

The present disclosure relates to a thermal break for use in construction. The present disclosure further relates to an exterior wall comprising the thermal break, and a method of constructing the exterior wall comprising the thermal break.

BACKGROUND

"Tilt-up" is a construction technique commonly used in constructing industrial-scale buildings such as warehouses. In tilt-up construction, an area of land is generally cleared of organic debris and other obstructions (e.g. boulders), and brought down to suitable elevation and grade. The land is checked to ensure that it is capable of supporting a building foundation. Footings lying around the perimeter of the area of land are poured. Wet concrete is then poured over the ground and allowed to set and form a concrete slab. The concrete slab forms the flooring of the building. To prevent surfaces bonding to the concrete slab, the concrete slab is sprayed with a chemically reactive bond breaker. Concrete elements such as walls (e.g. exterior walls) are then formed horizontally on top of the concrete slab by pouring wet concrete into a pre-defined area defined by a wood formwork. The wet concrete sets to form the concrete element. The wood formwork is removed, and the concrete element is then tilted to an upright position from a horizontal position and positioned at the perimeter of the concrete slab.

Exterior walls made for tilt-up construction generally comprise: (i) an exterior layer called a fascia wythe; (ii) an interior layer called a structural wythe; and (iii) insulating material therebetween. To form an exterior wall, welded wire mesh is laid within the pre-defined area defined by the wood formwork, and a first layer of wet concrete is poured over the welded wire mesh. This first layer of wet concrete sets and forms the fascia wythe. Before the first layer of wet concrete sets, insulating material is positioned over the first layer of wet concrete and coupled to the first layer of wet concrete by methods known in the art. For example, insulating material may be coupled to the fascia wythe via wythe ties (e.g. Thermomass® GFRP wythe ties). The insulating material is generally a non-weight bearing insulating material (e.g. extruded polystyrene insulation). Once the first layer of wet concrete has set, reinforcing bars are laid out over the insulating material, and a second layer of wet concrete is poured over the reinforcing bars and insulating material. The second layer of wet concrete is coupled to the insulating material by methods known in the art and sets to form the structural wythe. A construction crane may then be used to manoeuvre the exterior wall to its desired upright location and position.

Previously, building energy codes pertaining to industrial buildings did not require an exterior wall to be insulated. As such, it was common practice to have only the structural wythe as the exterior wall (i.e. no insulating material and no fascia wythe), and to mount fixtures directly onto the structural wythe. Fixtures include, but are not limited to, door frames, window frames venting grills or other building components.

Presently, many energy efficiency standards require the exterior walls of new industrial buildings (including "tilt-up" concrete buildings) to be insulated. In order to meet such standards, it is common to construct an exterior wall that comprises a fascia wythe and a structural wythe, wherein the two layers of wythe are separated by insulating material or a thermal break at all locations therebetween. Such an exterior wall is exemplified in FIG. 1(*a*), which shows a structural wythe 110 and a fascia wythe 120 of an exterior wall 100 separated by insulating material 130.

In practice, a fixture (e.g. a door frame) is mounted onto a side edge of the exterior wall such that the width of the fixture covers the insulating material that extends to the side edge of the exterior wall. The weight of the fixture is supported by the weight-bearing structural wythe. The fixture also acts as a barrier that reduces the loss of thermal energy where the insulating material meets the side edge of the exterior wall. As neither the insulating material nor the fascia wythe is weight-bearing, direct mounting of the fixture onto the insulating material or fascia wythe may result in structural failure over time. To improve the overlap between the fixture and the weight-bearing structural wythe, the shape of the insulating material and the shape of the structural wythe may be modified such that only a narrow rib of insulating material extends towards the side edge of the exterior wall. In this arrangement, and referring to FIG. 1(*b*), a fixture 140 may be mounted mainly to the structural wythe 110 while still covering surface 130*a* of the insulating material 130. However, because the fixture 140 still overlaps at least a portion of the non-weight-bearing insulating material 130 (i.e. over insulating material surface 130*a*), structural failure where the fixture overlaps with the non-weight-bearing insulating material may still occur over time.

To further provide weight-loading support to the fixture, a piece of wood 150 may be positioned between insulating material 130 and the side edge of the exterior wall as shown in FIG. 1(*c*). The wood 150 acts as a heat loss barrier and also provides a mounting and weight-bearing surface for fixture 140 to be mounted on. However, wood and concrete expand and contract at different rates, and the combination may eventually lead to mechanical failure. In addition, moisture may access the piece of wood, and may lead to wood rot over time.

Accessory items, for example but not limited to canopies, are sometimes required to be affixed to the sides of the exterior walls. Typically, the accessory item is directly mounted onto the fascia wythe with one or more suitable fasteners such as, but not limited to, a threaded rod (e.g. Type 304SS ⅜" all-thread rods). The fastener typically penetrates through the fascia wythe, the insulating material, and partially through the structural wythe, thereby locking the structural wythe and fascia wythe together. Such locking of the structural wythe and fascia wythe together does not accommodate for the potential thermal expansions of the structural wythe or the fascia wythe through the seasons, and may lead to cracking of the structural wythe and/or fascia wythe over time.

SUMMARY

The present disclosure relates to a thermal break for use in construction. The present disclosure further relates to an exterior wall comprising the thermal break, and a method of constructing the exterior wall comprising the thermal break.

The present disclosure further relates to a thermal break for use in insulation concrete forms.

According to an aspect of the disclosure, there is an exterior wall for tilt-up construction comprising: (a) a fascia wythe of the exterior wall; (b) a structural wythe of the exterior wall; (c) a layer of insulating material disposed between the fascia wythe and the structural wythe; and (d) a thermal break in contact with at least the structural wythe, the thermal break comprising an elongate body comprising one or more thermal insulating materials, a first surface suitable for mounting a fixture, a second surface opposite the first surface, a first contacting surface, and a second contacting surface opposite the first contacting surface, the first contacting surface and the second contacting surface extending between the first surface and the second surface; the elongate body substantially made of a non-wood material; and the structural wythe contacting at least a portion of the second contacting surface.

The exterior wall may further comprise one or more protrusions extending away from at least the second contacting surface. The structural wythe may surround the one or more protrusions extending away from the at least the second contacting surface.

According to an aspect of the disclosure, there is an exterior wall for tilt-up construction comprising: (a) a fascia wythe of the exterior wall; (b) a structural wythe of the exterior wall; (c) a layer of insulating material disposed between the fascia wythe and the structural wythe; and (d) a thermal break in contact with at least the structural wythe, the thermal break comprising an elongate body comprising one or more thermal insulating materials, a first surface suitable for mounting a fixture, a second surface opposite the first surface, a first contacting surface, and a second contacting surface opposite the first contacting surface, the first contacting surface and the second contacting surface extending between the first surface and the second surface; the elongate body substantially made of a non-wood material; and the structural wythe contacting at least a portion of the second contacting surface; wherein the thermal break further comprises one or more protrusions extending away from at least the second contacting surface; wherein the structural wythe surrounds the one or more protrusions extending away from at least the second contacting surface; and wherein the second surface contacts the insulating material, and wherein at least a portion of the first contacting surface contacts at least a portion of the fascia wythe.

The thermal break may further comprise one or more protrusions extending away from the first contacting surface, and the fascia wythe may surround the one or more protrusions extending away from the first contacting surface.

The R-value of the insulating material may be about 15.

According to an aspect of the disclosure, there is an exterior wall for tilt-up construction comprising: (a) a fascia wythe of the exterior wall; (b) a structural wythe of the exterior wall; (c) a layer of insulating material disposed between the fascia wythe and the structural wythe; and (d) a thermal break in contact with at least the structural wythe, the thermal break comprising an elongate body comprising one or more thermal insulating materials, a first surface suitable for mounting a fixture, a second surface opposite the first surface, a first contacting surface, and a second contacting surface opposite the first contacting surface, the first contacting surface and the second contacting surface extending between the first surface and the second surface; the elongate body substantially made of a non-wood material; and the structural wythe contacting at least a portion of the second contacting surface; wherein the thermal break further comprises one or more protrusions extending away from at least the second contacting surface; and wherein the second surface contacts the insulating material, and wherein the structural wythe further contacts at least a portion of the first contacting surface.

The thermal break may further comprise one or more protrusions extending away from the first contacting surface, and the structural wythe may surround the one or more protrusions extending away from the first contacting surface.

According to an aspect of the disclosure, there is an exterior wall for tilt-up construction comprising: (a) a fascia wythe of the exterior wall; (b) a structural wythe of the exterior wall; (c) a layer of insulating material disposed between the fascia wythe and the structural wythe; and (d) a thermal break in contact with at least the structural wythe, the thermal break comprising an elongate body comprising one or more thermal insulating materials, a first surface suitable for mounting a fixture, a second surface opposite the first surface, a first contacting surface, and a second contacting surface opposite the first contacting surface, the first contacting surface and the second contacting surface extending between the first surface and the second surface; the elongate body substantially made of a non-wood material; and the structural wythe contacting at least a portion of the second contacting surface; wherein the thermal break further comprises one or more protrusions extending away from at least the second contacting surface; and wherein the thermal break further comprises one or more protrusions extending away from the first contacting surface, and wherein the fascia wythe contacts the first contacting surface and surrounds the one or more protrusions extending away from the first contacting surface.

The one or more protrusions extending away from the first contacting surface and the one or more protrusions extending away from the second contacting surface may be integrally connected.

At least one of the one or more protrusions extending away from the first contacting surface or the second contacting surface may be constructed of an insulating material.

This summary does not necessarily describe the entire scope of all aspects of the disclosure. Other aspects, features and advantages will be apparent to those of ordinary skill in the art upon review of the following description of specific embodiments.

BRIEF DESCRIPTION OF THE DRAWINGS

In the accompanying drawings, which illustrate one or more exemplary embodiments:

FIG. 1(*a*) is a sectional view of a prior art "tilt-up" exterior wall comprising a structural wythe, a fascia wythe, and insulating material therebetween.

FIG. 1(*b*) is a sectional view of a prior art "tilt-up" exterior wall comprising a structural wythe, a fascia wythe, insulating material therebetween, and a fixture mounted to a surface of the structural wythe and a surface of the insulating material.

FIG. 1(*c*) is a sectional view of a prior art "tilt-up" exterior wall comprising a structural wythe, a fascia wythe, insulating material therebetween, and a piece of wood that separates the insulating material from a fixture, the fixture being mounted to a surface of the structural wythe and a surface of the piece of wood.

FIGS. 2(*b*), 2(*c*) and 2(*d*) are side views of different configurations of the thermal break of FIG. 2(*a*).

FIG. 2(*e*) is a top view of the thermal break of FIG. 2(*a*) with the first protrusions arranged in a row on a surface of the elongate body.

FIG. 2(*f*) is a top view of an alternative embodiment of the thermal break of FIG. 2(*a*) with the first protrusions arranged in a matrix on the surface of the elongate body.

FIG. 2(*g*) is a top view of an alternative embodiment of the thermal break of FIG. 2(*a*) with the first protrusions randomly arranged on the surface of the elongate body.

FIG. 5(*b*) is a side view of the thermal break depicted in FIG. 5(*a*), with the rods received in the bores to form first and second protrusions.

FIG. 5(*c*) is a side view of the thermal break depicted in FIG. 5(*b*), with the rods coupled to the elongate body by nuts.

FIG. 5(*d*) is a side view of the thermal break depicted in FIG. 5(*a*) with the rods coupled to the elongate body by nuts, and nuts coupled to the ends of at least one of the rods.

FIG. 6(*b*) is an end view of the thermal break depicted in FIG. 6(*a*).

FIG. 7(*b*) is a perspective view of a thermal break according to another embodiment, the thermal break comprising an elongate body with a cross-sectional shape of an hour-glass.

FIG. 8(*b*) is a side elevation view of the thermal break depicted in FIG. 8(*a*).

FIG. 9(*b*) is a cross-sectional front view of the thermal break depicted in FIG. 9(*a*) along line 9-9, revealing the additional insulating material within the elongate body.

FIGS. 10(*b*), 10(*c*) and 10(*d*) are side views of different configurations of the thermal break of FIG. 10(*a*).

FIG. 11(*a*) shows the thermal break coupled to the formwork; FIG. 11(*b*) shows the thermal break, and the fascia wythe and insulating material of the exterior wall; FIG. 11(*c*) shows the thermal break, and the fascia wythe, insulating material and structural wythe of the exterior wall.

FIG. 11(*d*) is a top view of the tilt-up exterior wall comprising the thermal break according to FIG. 2(*a*) with the formwork removed and a fixture mounted to the thermal break and a portion of the structural wythe.

FIG. 12(*a*) shows the thermal break supported by a supporting base, and positioned next to formwork; FIG. 12(*b*) shows the thermal break, a portion of the fascia wythe into which a portion of a reinforcing bar is immersed (as depicted in stippled lines), and insulating material; FIG. 12(*c*) shows the thermal break, and the fascia wythe and insulating material of the exterior wall; FIG. 12(*d*) shows the thermal break, and the fascia wythe, insulating material and structural wythe of the exterior wall.

FIG. 12(*e*) is a top view of the tilt-up exterior wall comprising the thermal break according to FIG. 9(*a*), with the formwork removed and a fixture mounted to the thermal break and a portion of the structural wythe.

FIG. 13(*a*) shows a formwork in which the exterior wall is constructed. FIG. 13(*b*) shows the thermal break, a portion of the fascia wythe into which a portion of a reinforcing bar is immersed (as depicted in stippled lines), and insulating material; FIG. 13(*c*) shows the thermal break, and the fascia wythe and insulating material of the exterior wall; FIG. 13(*d*) shows the thermal break, and the fascia wythe, insulating material and structural wythe of the exterior wall.

FIG. 15(*a*) shows a side-sectional view of the parapet structure, the parapet structure comprising a fascia wythe, a structural wythe, insulating material positioned between the fascia wythe and the structural wythe, and a thermal break surrounded by the structural wythe and touching the insulating material. FIG. 15(*b*) is a side view, during the tilt-up construction process, of a formwork in which the exterior wall is constructed. FIG. 15(*c*) is a side view, during the tilt-up construction process, of a first layer of concrete poured within the formwork, the first layer of concrete forming the fascia wythe when set. FIG. 15(*d*) is a side view, during the tilt-up construction process, showing an insulating material disposed on top of the fascia wythe, the insulating material extending to the edge of the formwork. FIG. 15(*e*) is a side view, during the tilt-up construction process, showing a thermal break disposed on the insulating material and away from the edge of the formwork. FIG. 15(*f*) is a side view, during the tilt-up construction process, showing a structural wythe contiguous with the insulating material and a first contacting surface and a second contacting surface of the thermal break. FIG. 15(*g*) is a side view, during the tilt-up construction process, showing an additional layer of insulating material contiguous with the structural wythe, the thermal break, and a support structure.

FIG. 16(*a*) is a top-sectional view of an exterior wall comprising a first and second portion of fascia wythe, a structural wythe, an insulating material contiguous with the first and second portion of fascia wythe, the structural wythe, and a thermal break, the thermal break contiguous with the structural wythe and the second portion of the fascia wythe, and a fixture overlapping a portion of the second portion of the fascia wythe and a portion of the thermal break. FIG. 16(*b*) is a side view, during the tilt-up construction process, of a first portion of the fascia wythe, the insulating material disposed on the first portion of the fascia wythe and at a pre-determined distance away from the edge of the formwork, and the thermal break disposed on the insulating material and at a pre-determined distance away from the edge of the formwork. FIG. 16(*c*) is a side view, during the tilt-up construction process, of an exterior wall comprising the second portion of the fascia wythe, the thermal break, the structural wythe, the insulating material, and the first portion of the fascia wythe, prior to tilt-up.

FIG. 17(*a*) is a top-sectional view of an exterior wall comprising a fascia wythe, a plurality of structural wythes, insulating materials separating the structural wythes from the fascia wythe, thermal breaks separating the structural wythes from the fascia wythe, and a rod extending through the structural wythes, the thermal breaks, and the fascia wythe. FIG. 17(*b*) is a side view, during the tilt-up construction process, of a first portion of a fascia wythe comprising an embed that is embedded therein. FIG. 17(*c*) is a side view, during the tilt-up construction process, of thermal break bodies and insulating material positioned on the first portion of the fascia wythe. FIG. 17(*d*) is a side view, during the tilt-up construction process, of a rod extending through the thermal break bodies. FIG. 17(*e*) is a side view, during the tilt-up construction process, of the exterior wall comprising a fascia wythe, a plurality of structural wythes, insulating materials separating the structural wythes from the fascia wythe, thermal breaks separating the structural wythes from the fascia wythe, and a rod extending through the structural wythes, the thermal breaks, and the fascia wythe.

Figure 2A:
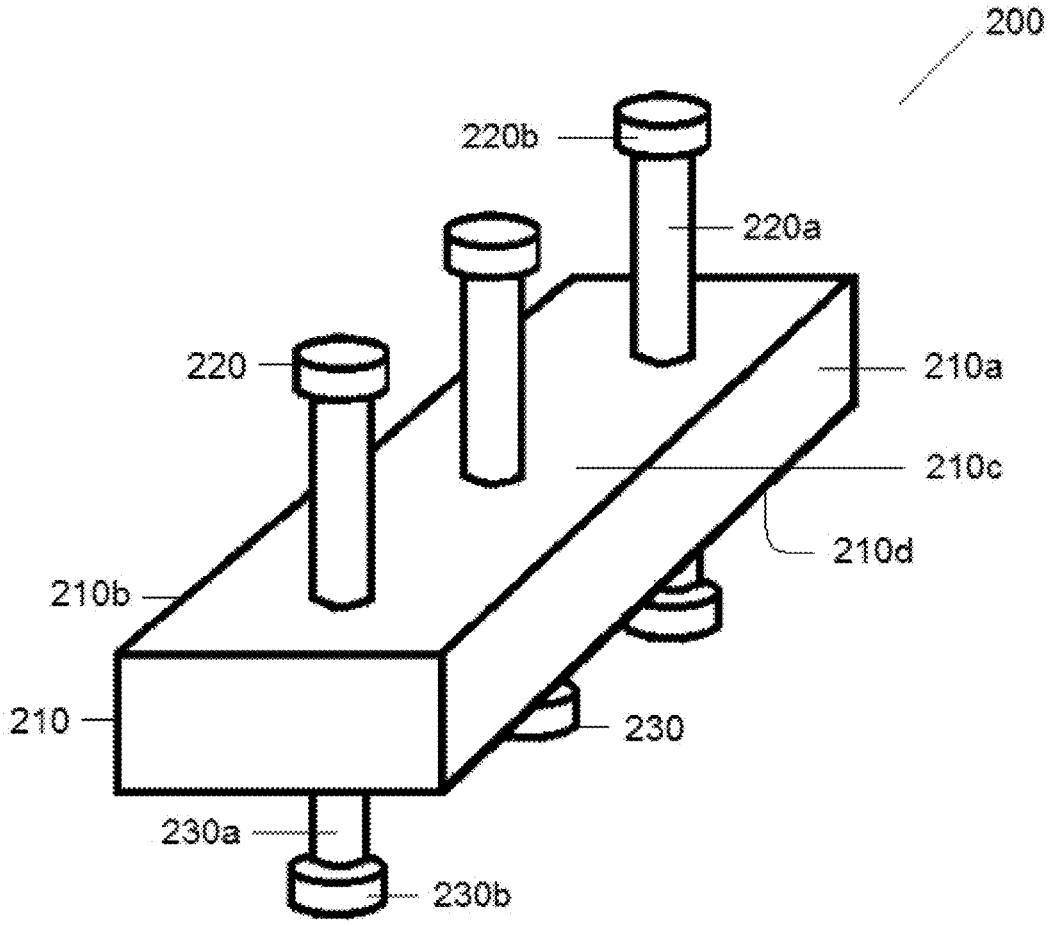
FIG. 2(*a*) is a perspective view of a thermal break according to an embodiment, the thermal break comprising an elongate body, and first protrusions and second protrusions extending from the elongate body.
Figure 2B:
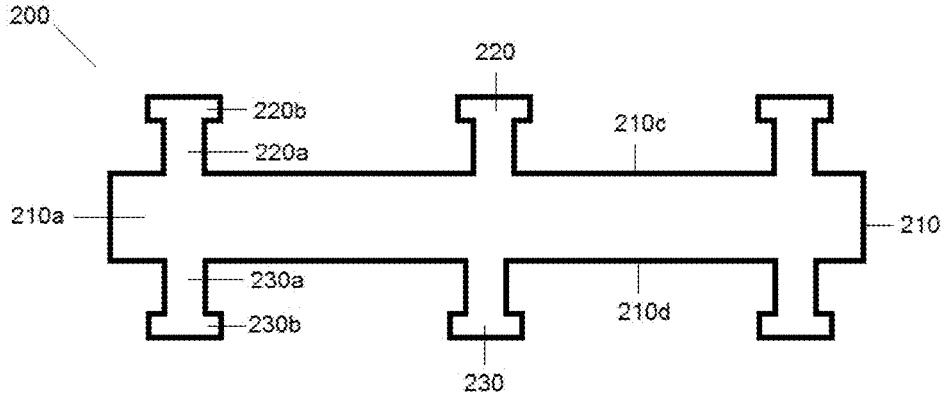
Figure 2C:
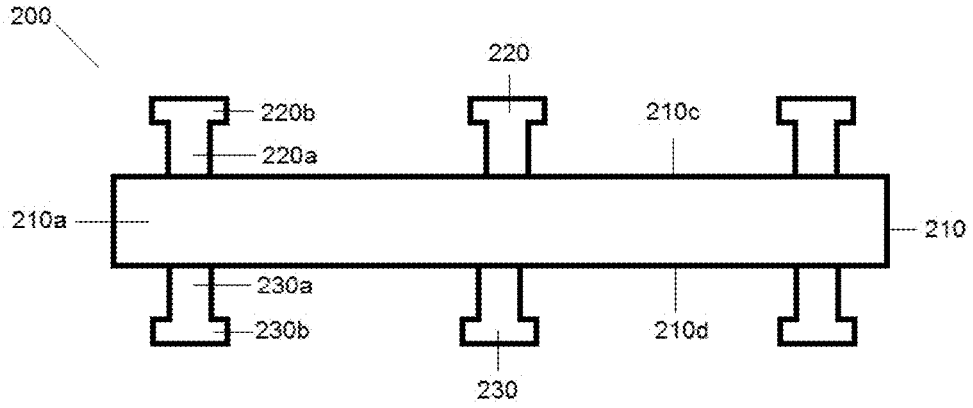
Figure 2D:
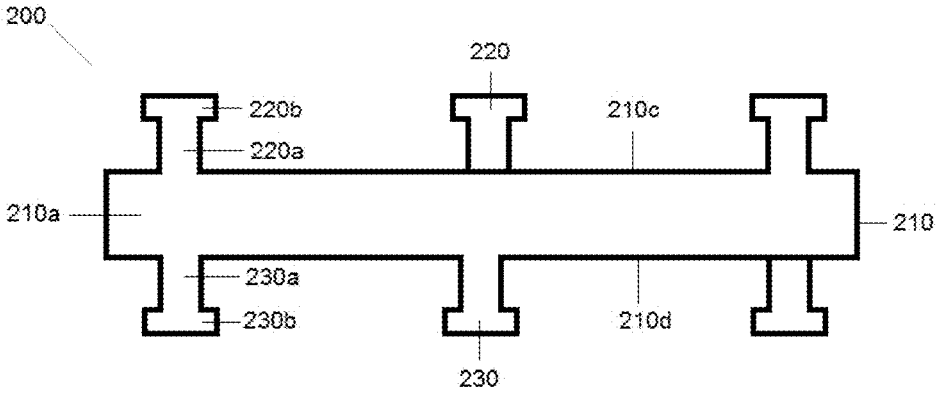
Figure 2G:
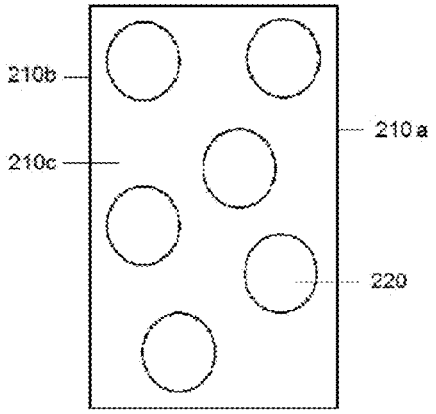
Figure 2F:
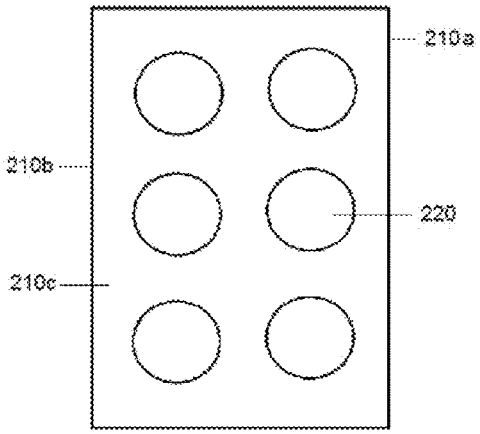
Figure 2E:
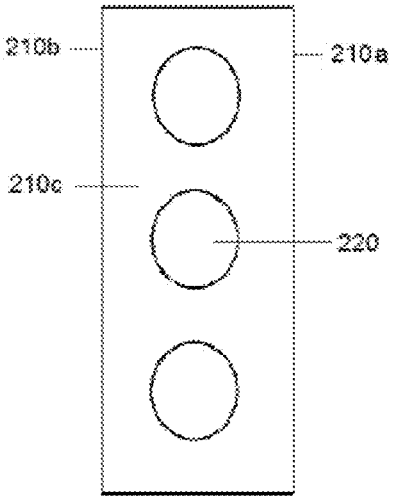

The drawings are for illustrative purposes only, and are not drawn to scale. The dimensions of the components of the thermal break may be of any suitable dimensions.

DETAILED DESCRIPTION

Directional terms such as "top," "bottom," "upwards," "downwards," "vertically," and "laterally" are used in the following description for the purpose of providing relative reference only, and are not intended to suggest any limitations on how any article is to be positioned during use, or to be mounted in an assembly or relative to an environment. Any element expressed in the singular form also encompasses its plural form. Any element expressed in the plural form also encompasses its singular form.

The present disclosure relates to a thermal break for use in construction. The present disclosure also relates to a thermal break for use in tilt-up construction that provides a weight-bearing surface to which a fixture may be mounted. The present disclosure further relates to an exterior wall comprising the thermal break, and a method of constructing the exterior wall comprising the thermal break. The present disclosure further relates to a thermal break for use in insulation concrete forms.

Thermal Break

Referring to FIGS. 2(*a*) to 2(*g*), and according to an embodiment of the disclosure, there is shown a thermal break 200 suitable for use in exterior walls for tilt-up construction. Thermal break 200 comprises an elongate body 210 comprising a first surface 210*a*, and a second surface 210*b* that is opposite the first surface 210*a*. In addition, two opposite contacting surfaces 210*c* and 210*d* extend between first surface 210*a* and second surface 210*b*. First surface 210*a* is suitable for mounting a fixture, second surface 210*b* is suitable for mounting or contacting an insulating material, contacting surface 210*c* is suitable for contacting at least a portion of a fascia wythe, and contacting surface 210*d* is suitable for contacting at least a portion of a structural wythe.

Thermal break 200 further comprises first protrusions 220 which couple to and extend away from contacting surface 210*c*, and second protrusions 230 which couple to and extend away from contacting surface 210*d*. First protrusions 220 and second protrusions 230 extend away from the elongate body 210 in opposite directions. First protrusions 220 each comprise an elongate extension 220*a* and a head 220*b*. Second protrusions 230 each comprise an elongate extension 230*a* and a head 230*b*. Elongate extensions 220*a*, 230*a* separate the elongate body 210 from heads 220*b*, 230*b*. Elongate extensions 220*a*, 230*a* are depicted in FIGS. 2(*a*) to 2(*d*) as cylindrical. However, in other embodiments, elongate extensions 220*a*, 230*a* may be any suitable shape such as, but not limited to, a geometric prism, a frustum or an inverted frustum. Heads 220*b*, 230*b* are depicted as cylindrical in FIGS. 2(*a*) to 2(*d*), and have a greater cross sectional area than elongate extensions 220*a*, 230*a*. In other embodiments, head 220*b*, 230*b* may be any suitable shape such as, but not limited to, a sphere, an ovoid, or a square or geometric prism. In FIGS. 2(*a*) to 2(*d*), first protrusions 220 and second protrusions 230 are depicted as extending orthogonally away from contacting surfaces 210*c* and 210*d* respectively. However, in other embodiments, first protrusions 220 and second protrusions 230 may extend away from contacting surfaces 210*c* and 210*d* respectively in a non-orthogonal manner.

Referring to FIG. 2(*b*), first protrusions 220 and second protrusions 230 are formed from the same material as elongate body 210 and are integrally formed with elongate body 210 such that thermal break 200 is one continuous piece. Alternatively, and as depicted in FIG. 2(*c*), first protrusions 220 and second protrusions 230 are not integrally formed with elongate body 210. In such an alternative, first protrusions 220 and second protrusions 230 are coupled to elongate body 210 by methods known in the art. For example, elongate body 210 may have one or more receivers (not shown) in contacting surface 210*c* and contacting surface 210*d* of elongate body 210. First protrusions 220 and second protrusions 230 may couple to elongate body 210 by inserting one or more extensions (not shown) coupled to and extending away from first protrusions 220 and second protrusions 230 into the one or more receivers in contacting surface 210*c* and contacting surface 210*d* of elongate body 210. Alternatively, and as depicted in FIG. 2(*d*), one or more protrusions 220, 230 are integrally formed with elongate body 210, while one or more protrusions 220, 230 are not. In other embodiments, first protrusions 220 and second protrusions 230 are made of a material (e.g. metal, metal alloy, or a plastic) that is different from the material of elongate body 210.

As described in greater detail below, during "tilt-up" construction of an exterior wall, wet concrete contacts contacting surface 210*c*, immerses first protrusions 220, and sets to form the fascia wythe of the exterior wall. Wet concrete also contacts contacting surface 210*d*, immerses second protrusions 230, and sets to form the structural wythe of the exterior wall. Heads 220*b*, 230*b* may beneficially anchor the thermal break 200 to the fascia wythe and the structural wythe. Additional anchoring surfaces or extensions (not shown) may be added to the first and second protrusions 220, 230. As depicted in FIGS. 2(*a*) to 2(*e*), first protrusions 220 are arranged in a row on contacting surface 210*c* of elongate body 210. In other embodiments, first protrusions 220 may be arranged in any arrangement, for example in two or more rows on contacting surface 210*c* of elongate body 210 (as depicted in FIG. 2(*f*)), or randomly on contacting surface 210*c* of elongate body 210 (as depicted in FIG. 2(*g*)). Second protrusions 230 may have the same arrangement on contacting surface 210*d* of elongate body 210 as the first protrusions 220 or a different arrangement.

Figure 3:
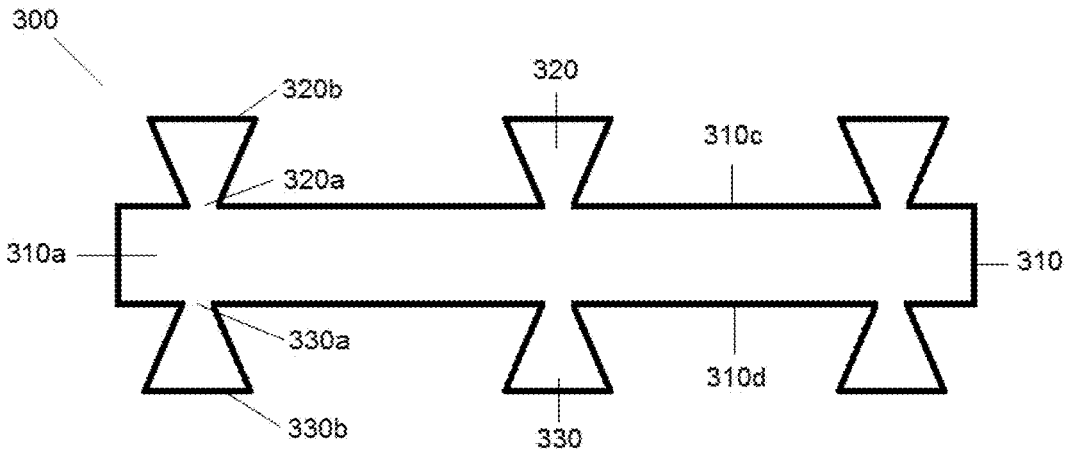
FIG. 3 is a side-sectional view of a thermal break according to another embodiment with the first protrusions and the second protrusions shaped as inverted frustums.

Referring to FIG. 3, and according to another embodiment of the disclosure, there is shown a thermal break 300 suitable for use in exterior walls for tilt-up construction. Thermal break 300 comprises an elongate body 310 having a first surface 310*a* and a second surface (not shown) that is opposite surface 310*a*. In addition, two opposite contacting surfaces 310*c* and 310*d* extend between first surface 310*a* and the second surface (not shown) that is opposite surface 310*a*. First surface 310*a* is suitable for mounting a fixture, the second surface that is opposite first surface 310*a* is suitable for mounting or contacting an insulating material, contacting surface 310*c* is suitable for contacting a fascia wythe, and contacting surface 310*d* is suitable for contacting a structural wythe. Thermal break 300 further comprises first protrusions 320 which couple to and extend away from contacting surface 310*c*, and second protrusions 330 which couple to and extend away from contacting surface 310*d*.

First protrusions 320 each comprise a first end 320*a* and a second end 320*b*. Second protrusions 330 each comprise a first end 330*a* and a second end 330*b*. The first end 320*a*, 330*a* of each protrusion 320, 330 is coupled to the elongate body 310 and has a smaller cross sectional area (i.e. is less wide) than the second end 320*b*, 330*b* of each protrusion 320, 330. Protrusions 320, 330 may be any suitable shape such as, but not limited to, an inverted conical frustum, an inverted square frustum, or other inverted geometric frustum. The wider second ends 320*b*, 330*b* of the protrusions 320, 330 may beneficially anchor thermal break 300 to the fascia wythe and the structural wythe. Additional anchoring surfaces or extensions (not shown) may be added to protrusions 320, 330.

Figure 4:
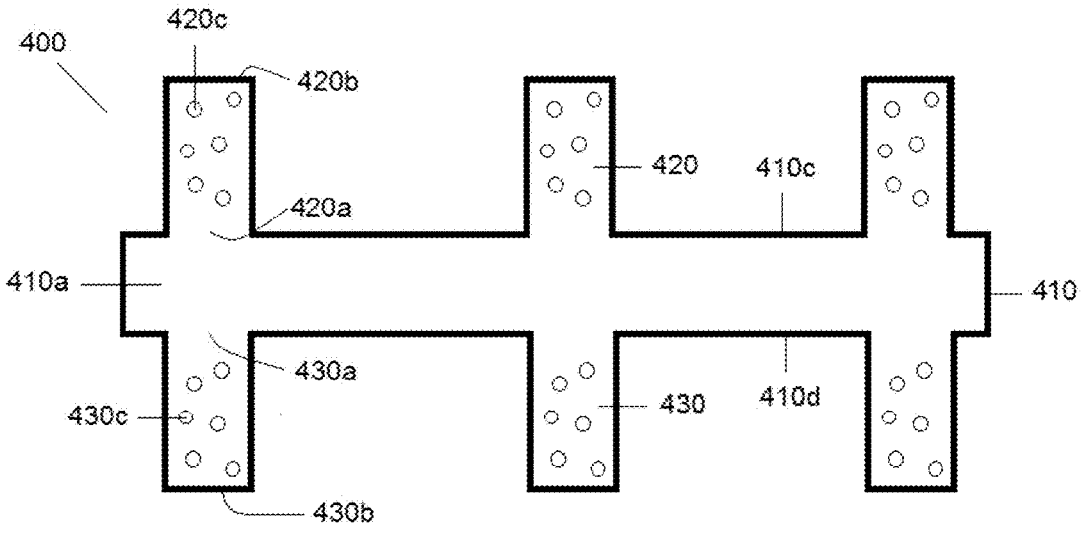
FIG. 4 is a side-sectional view of a thermal break according to another embodiment with the first protrusions and second protrusions being porous.
Figure 5A:
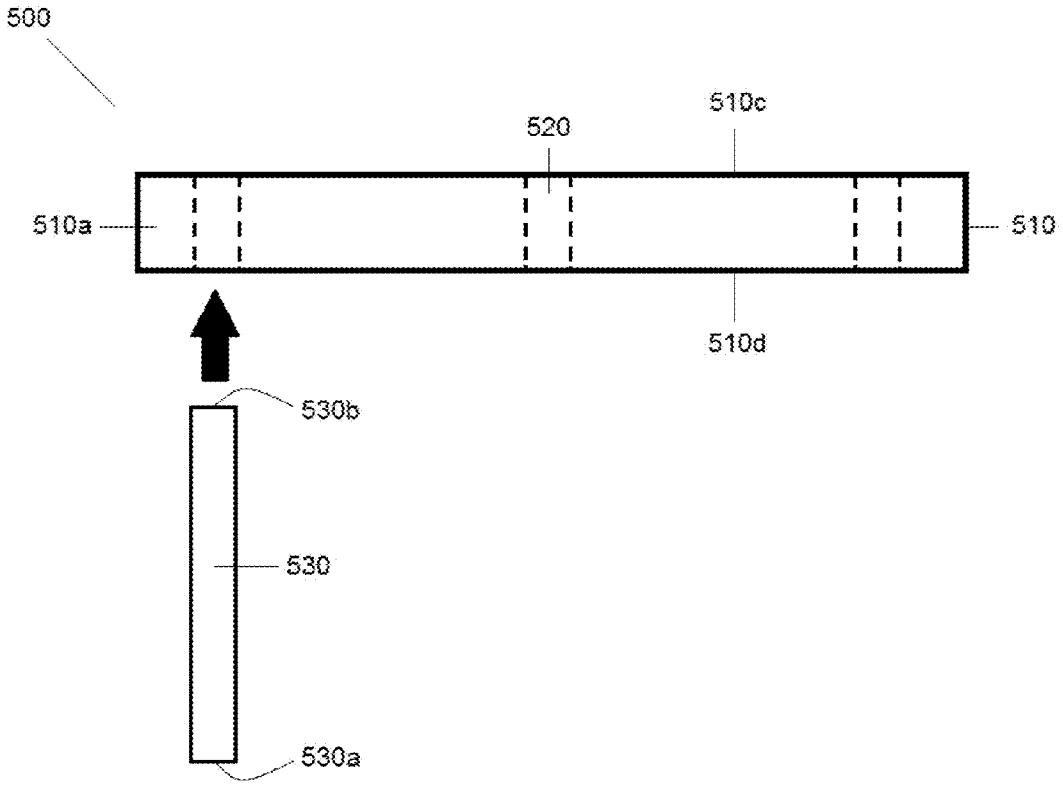
FIG. 5(*a*) is a side view of a thermal break according to another embodiment comprising an elongate body with bores extending therethrough and rods for inserting through the bores.
Figure 5B:
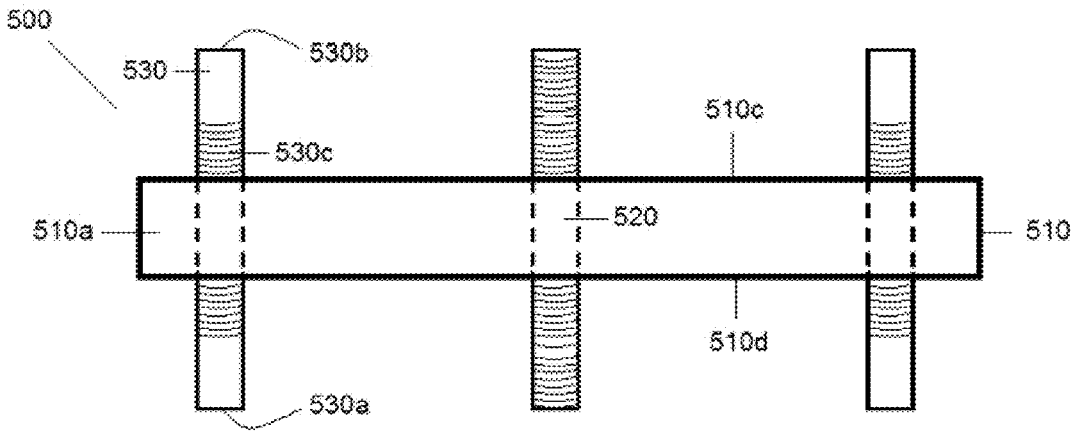
Figure 5C:
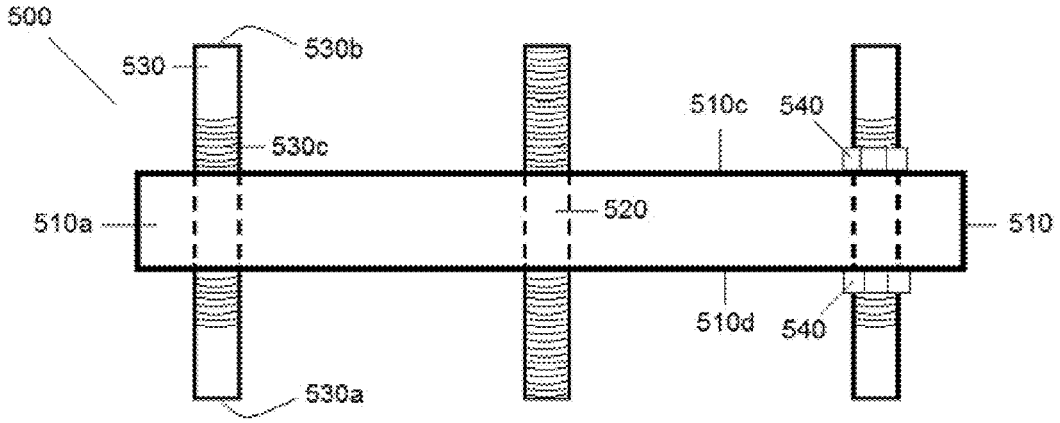
Figure 5D:
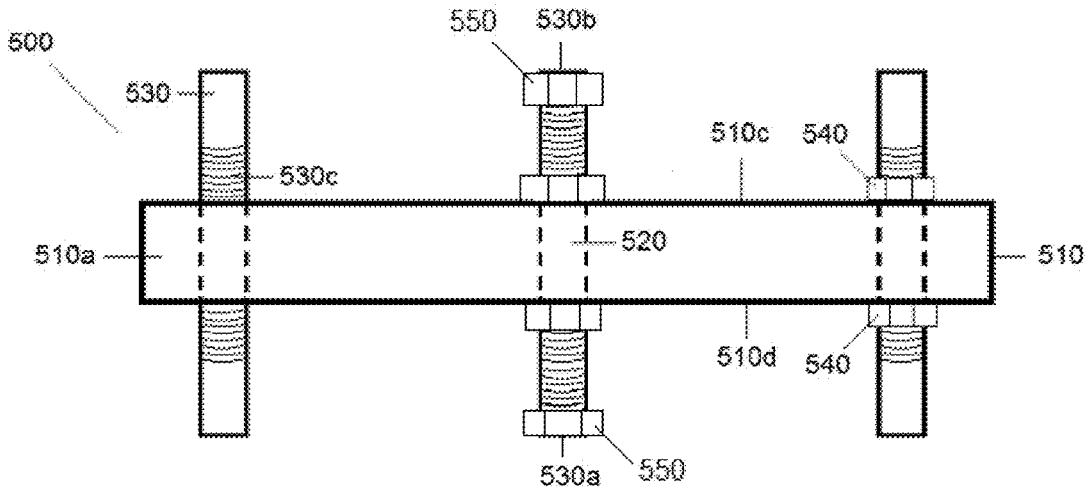

Referring to FIG. 4, and according to another embodiment of the disclosure, there is shown a thermal break 400 suitable for use in exterior walls for tilt-up construction. Thermal break 400 comprises an elongate body 410 having a first surface 410*a* and a second surface (not shown) that is opposite surface 410*a*. Two opposite contacting surfaces 410*c* and 410*d* extend between first surface 410*a* and the second surface (not shown) that is opposite surface 410*a*. First surface 410*a* is suitable for mounting a fixture, the second surface (not shown) that is opposite surface 410*a* is suitable for mounting or contacting an insulating material, contacting surface 410*c* is suitable for contacting a fascia wythe, and contacting surface 410*d* is suitable for contacting a structural wythe. Thermal break 400 further comprises first protrusions 420 which couple to and extend away from contacting surface 410*c*, and second protrusions 430 which couple to and extend away from contacting surface 410*d*.

First protrusions 420 each comprise a first end 420*a* and a second end 420*b*, and second protrusions 430 each comprise a first end 430*a* and a second end 430*b*. The first end 420*a*, 430*a* of each protrusion 420, 430 is coupled to the elongate body 410. While the widths of the first end 420*a*, 430*a* and the second end 420*b*, 430*b* of each protrusion 420, 430 are depicted as being the same in FIG. 4, the second end 420*b*, 430*b* may be wider than the first end 420*a*, 430*a* (similar to the embodiment depicted in FIG. 3), or narrower than the first end 420*a*, 430*a*. In addition, protrusions 420, 430 may be of any suitable shape such as, but not limited to, a cylinder or other geometric prism, an inverted frustum, or a frustum. Protrusions 420, 430 comprise one or more pores 420*c*, 430*c*, which may partially extend into protrusions 420, 430 or extend through protrusions 420, 430. Pores 420*c*, 430*c* increase the surface area of protrusions 420, 430 that interacts with the wet concrete that sets to form the fascia and structural wythes. The wet concrete may enter pores 420*c*, 430*c* and set within pores 420*c*, 430*c*, thereby resulting in concrete extensions into protrusions 420, 430. These concrete extensions further anchor the thermal break 400 to the fascia and structural wythes. Additional anchoring surfaces or extensions (not shown) may be added to protrusions 420, 430.

Referring to FIGS. 5(*a*) to 5(*d*), and according to another embodiment of the disclosure, there is shown of a thermal break 500 suitable for use in exterior walls for tilt-up construction. Thermal break 500 comprises an elongate body 510 having a first surface 510*a* and a second surface (not shown) that is opposite surface 510*a*. Two opposite contacting surfaces 510*c* and 510*d* extend between first surface 510*a* and the second surface (not shown) that is opposite surface 510*a*. First surface 510*a* is suitable for mounting a fixture, the second surface that is opposite surface 510*a* is suitable for mounting or contacting an insulating material, contacting surface 510*c* is suitable for contacting a fascia wythe, and contacting surface 510*d* is suitable for contacting a structural wythe.

Thermal break 500 further comprises bores 520 that extend through elongate body 510 between contacting surfaces 510*c* and 510*d*. Bores 520 may be formed in elongate body 510 after elongate body 510 has cured from its manufacturing process. In the alternative, bores 520 are formed during the molding process of elongate body 510. Three bores 520 are depicted in FIGS. 5(*a*) to 5(*d*). However, in other embodiments, any number of bores 520 may be formed in elongate body 510. In FIGS. 5(*a*) to 5(*d*), the bores 520 are arranged in a column or row through elongate body 510 between contacting surfaces 510*c* and 510*d*. In other embodiments, bores 520 may be arranged in one or more columns and rows through elongate body 510, or randomly through the elongate body 510 between contacting surfaces 510*c* and 510*d*.

Rods 530 each comprise an end portion 530*a*, an end portion 530*b* and a middle portion extending between the end portion 530*a* and the end portion 530*b*. Referring to FIG. 5(*b*), the middle portion of each rod 530 is received within one of the bores 520 of the elongate body 510, the end portion 530*b* forms a first protrusion, and the end portion 530*a* forms a second protrusion. A portion of the end portions 530*a*, 530*b* of each rod 530 that is adjacent the elongate body 510 is threaded with threads 530*c*. To secure rods 530 in their desired positions relative to elongate body 510, washers (not shown) are received on the end portion 530*a* and end portion 530*b* and positioned adjacent the elongate body 510. Referring to FIG. 5(*c*), nuts 540 are received on the end portion 530*a* and end portion 530*b* of the rods 530, and engage the threads 530*c* on either side of elongate body 510. The nuts 540 engage threads 530*c* in a manner such that the washers (not shown) are pressed against contacting surfaces 510*c* and 510*d* of elongate body 510, and the nuts 540 prevent rod 530 from shifting relative to the elongate body 510. In other embodiments, washers may not be present. In other embodiments, any suitable fastener known in the art, such as a clip or bolt, may be used to secure rods 530 relative to elongate body 510.

Rods 530 and bores 520 may be of any suitable shape such as, but not limited to, a cylinder or other geometric prism. Rods 530 and nuts 540 may be made of a nylon material. In other embodiment, rods 530 and nuts 540 may be made of any suitable material such as metal, metal alloy, insulating materials, or plastic materials. Insulating materials such as, but not limited to, fibre-glass provide additional insulating properties to the exterior wall comprising the thermal break. Anchoring surfaces or extensions may be added to the rods 530, and these anchoring surfaces or extensions may further anchor the thermal break 500 to the fascia wythe and/or the structural wythe. For example, and as depicted in FIG. 5(*d*), ends of end portions 530*a*, 530*b* of rod 530 may be threaded to receive one or more additional nuts 550. Additional nut 550 may be threaded onto rod 530 and spaced from contacting surfaces 510*c* and 510*d* of elongate body 510 to provide an anchoring structure for the wet concrete of the fascia and structural wythes to surround during construction of an exterior wall.

Figure 6A:
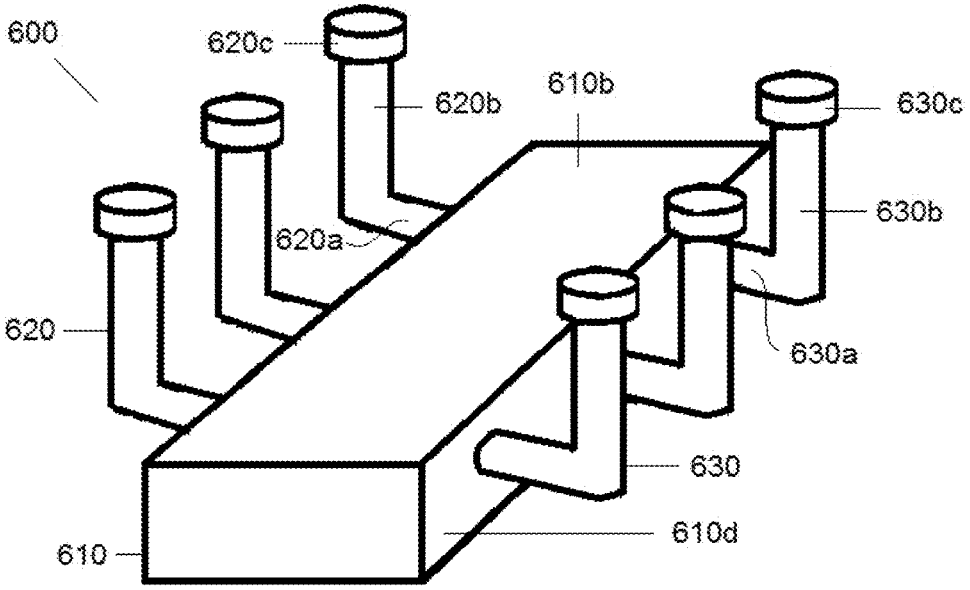
FIG. 6(*a*) is a perspective view of a thermal break according to another embodiment comprising an elongate body, and first protrusions and second protrusions extending from the elongate body.
Figure 6B:
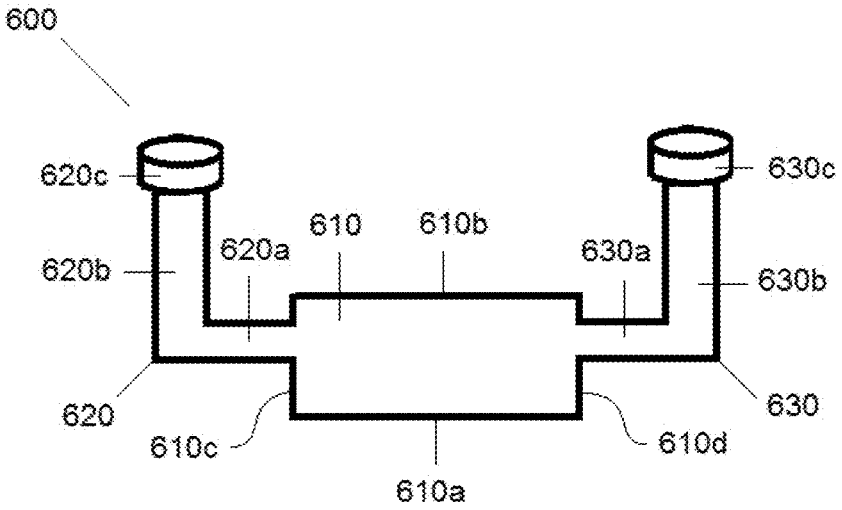

Referring to FIGS. 6(*a*) and 6(*b*), and according to another embodiment, there is shown a thermal break 600 suitable for use in exterior walls for tilt-up construction. Thermal break 600 comprises an elongate body 610 comprising a first surface 610*a* and an opposite second surface 610*b*. Two opposite contacting surfaces 610*c* and 610*d* extend between first surface 610*a* and second surface 610*b*. Thermal break 600 further comprises first protrusions 620 which couple to contacting surface 610*c*, and second protrusions 630 which couple to contacting surface 610*d*. First surface 610*a* is suitable for mounting a fixture, second surface 610*b* is suitable for mounting or contacting an insulating material, contacting surface 610*c* is suitable for contacting a fascia wythe, and contacting surface 610*d* is suitable for contacting a structural wythe.

First protrusions 620 each comprise a first extension 620*a*, a second extension 620*b*, and a head 620*c*. Second protrusions 630 each comprise a first extension 630*a*, a second extension 630*b*, and a head 630*c*. First extension 620*a*, 630*a* extends away from elongate body 610. Second extension 620*b*, 630*b* is coupled to first extension 620*a*, 630*b* and extends away from first extension 620*a*, 630*b*. Head 620*c*, 630*c* is coupled to second extension 620*b*, 630*b*.

As depicted in FIG. 6(*a*), second extension 620*b*, 630*b* is integrally formed with first extension 620*a*, 630*a*. However, in other embodiments, second extension 620*b*, 630*b* may not be integrally formed with first extension 620*a*, 630*a*. Extensions 620*a*, 620*b*, 630*a*, 630*b* are depicted in FIGS. 6(*a*) and 6(*b*) as cylindrical. However, in other embodiments, extensions 620*a*, 620*b*, 630*a*, 630*b* may be any suitable shape such as, but not limited to, a geometric prism, a frustum or an inverted frustum. Head 620*c*, 630*c* is connected to second extension 620*b*, 630*b*. As depicted in FIGS. 6(*a*) and 6(*b*), head 620*c*, 630*c* are cylindrical, and have a greater cross sectional area than second elongate extension 620*b*, 630*b*. However, in other embodiments, head 620*c*, 630*c* may be any suitable shape such as, but not limited to, a sphere, an ovoid, or a square or geometric prism.

In general, the axis along which a first extension extends away from elongate body 610 intersects and does not overlap with the axis along which a second extension extends away from the first extension. As depicted in FIGS. 6(*a*) and 6(*b*), second extension 620*b*, 630*b* is perpendicular to first extension 620*a*, 630*a*. In other embodiments, second extension 620*b*, 630*b* may be arranged in any suitable spatial orientation relative to first extension 620*a*, 630*a*.

As depicted in FIG. 6(*b*), first protrusions 620 and second protrusions 630 are formed from the same material as elongate body 610 and are integrally formed with elongate body 610 such that thermal break 600 is one continuous piece. Alternatively, first protrusions 620 and second protrusions 630 are not integrally formed with elongate body 610, and instead, first protrusions 620 and second protrusions 630 are coupled to elongate body 610 by methods known in the art. Alternatively, one or more protrusions 620, 630 are integrally formed with elongate body 610, while one or more protrusions 620, 630 are not. In other embodiments, first protrusions 620 and second protrusions 630 are made of a material (e.g. metal, metal alloy, or a plastic) that is different from the material of elongate body 610. In alternative embodiments, head 620*c* and/or head 630*c* may not be present.

During "tilt-up" construction of an exterior wall, wet concrete contacts contacting surface 610*c*, immerses the first protrusions 620, and sets to form the fascia wythe of the exterior wall. Wet concrete also contacts contacting surface 610*d*, immerses the second protrusions 630, and sets to form the structural wythe of the exterior wall. Heads 620*c*, 630*c*, and the spatial orientation of second extension 620*b*, 630*b* relative to first extension 620*a*, 630*a*, may beneficially anchor the thermal break 600 to the fascia wythe and the structural wythe. Additional anchoring surfaces or extensions (not shown) may be added to the first and second protrusions 620, 630.

Figure 7A:
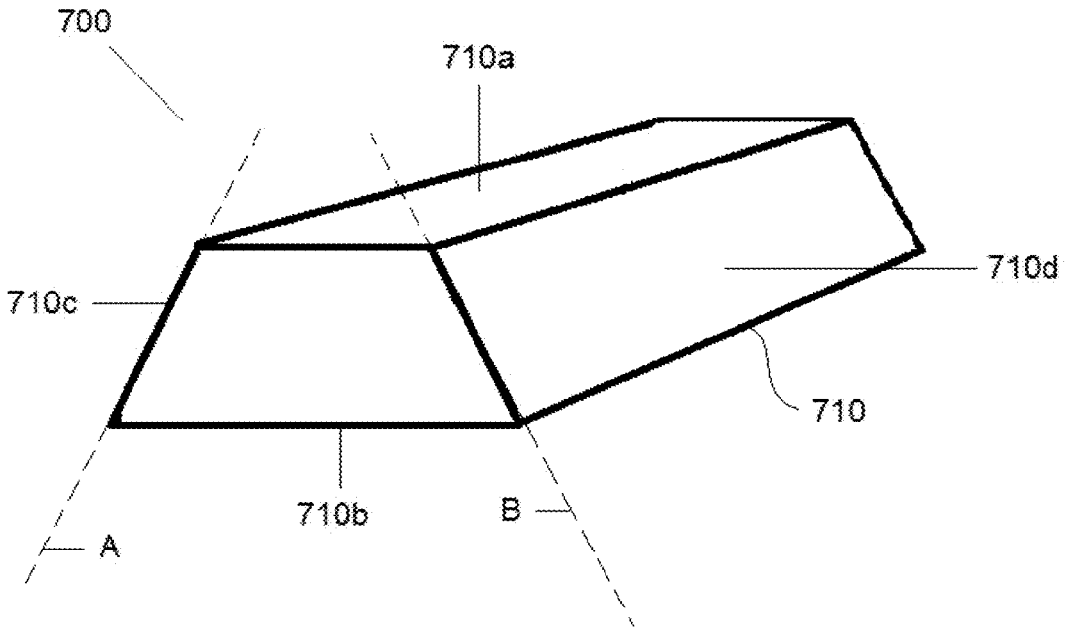
FIG. 7(*a*) is a perspective view of a thermal break according a configuration of another embodiment, the thermal break comprising an elongate body with a cross-sectional shape of a trapezoid.
Figure 7B:
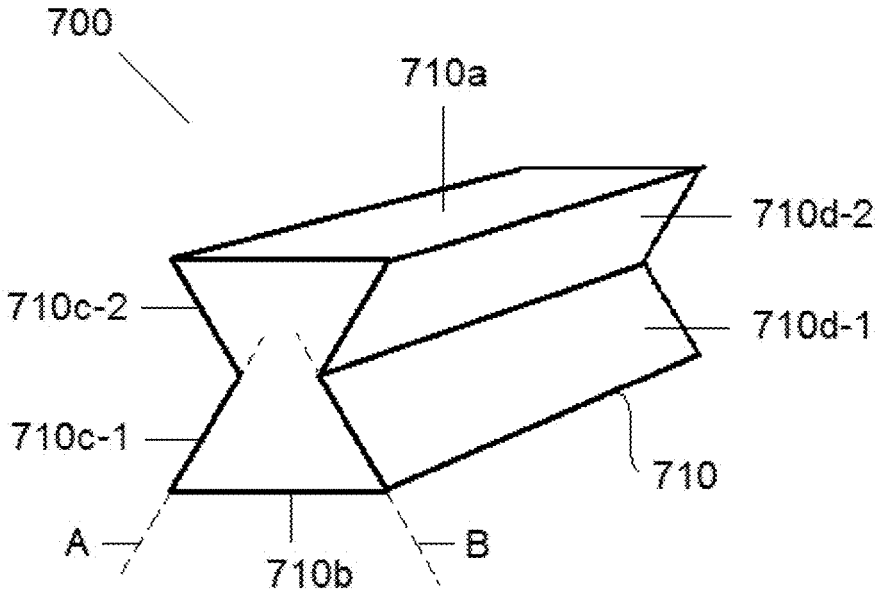

Referring to FIGS. 7(*a*) and 7(*b*), and according to another embodiment, there is shown a thermal break 700 suitable for use in exterior walls for tilt-up construction. Thermal break 700 comprises an elongate body 710 comprising a first surface 710*a* and an opposite second surface 710*b*. In addition, two opposite contacting surfaces 710*c* and 710*d* extend between first surface 710*a* and second surface 710*b*. First surface 710*a* is suitable for mounting a fixture, second surface 710*b* is suitable for mounting or contacting an insulating material, contacting surface 710*c* is suitable for contacting a fascia wythe, and contacting surface 710*d* is suitable for contacting a structural wythe. Contacting surface 710*c* comprises a first surface portion that extends along a first axis; contacting surface 710*d* comprises a first surface portion that extends along a second axis; the first and second axes converge towards each other. The converging first and second axes prevent the thermal break 700 from shifting between the structural and fascia wythes.

Referring to FIG. 7(*a*) and according to a configuration of this embodiment, thermal break 700 is a prism with a cross-sectional shape of an isosceles trapezoid. In other configurations, the thermal break 700 may be any suitable shape. In the thermal break 700 depicted in FIG. 7(*a*), surface 710*b* has a width that is greater than fixture-mounting surface 710*a*. The first surface portion of contacting surface 710*c* is the entire contacting surface 710*c*, and the first surface portion of contacting surface 710*d* is the entire contacting surface 710*d*. Contacting surface 710*c* extends along a first axis A, and contacting surface 710*d* extends along a second axis B. Axes A and B converge towards each other.

Referring to FIG. 7(*b*) and according to another configuration of this embodiment, thermal break 700 is a prism with a cross-sectional shape of an hour-glass. Contacting surface 710*c* is divided into two surface portions: surface portion 710*c*-1 and surface portion 710*c*-2. Contacting surface 710*d* is divided into two surface portions: surface portion 710*d*-1 and surface portion 710*d*-2. Surface portion 710*c*-1 extends along a first axis A, and surface portion 710*d*-1 extends along a second axis B. Axes A and B converge towards each other. The axes of surface portion 710*c*-2 and 710*d*-2 also converge towards each other to give the cross-sectional shape of an hour glass.

Figure 8A:
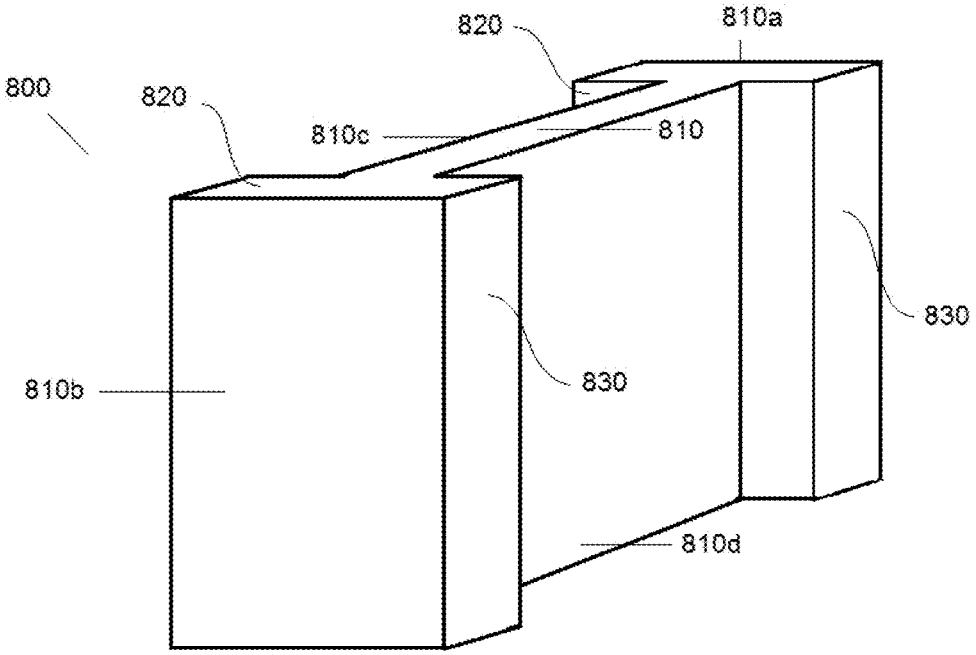
FIG. 8(*a*) is a perspective view of a thermal break according to another embodiment, the thermal break comprising a cross-sectional shape of an "I".
Figure 8B:
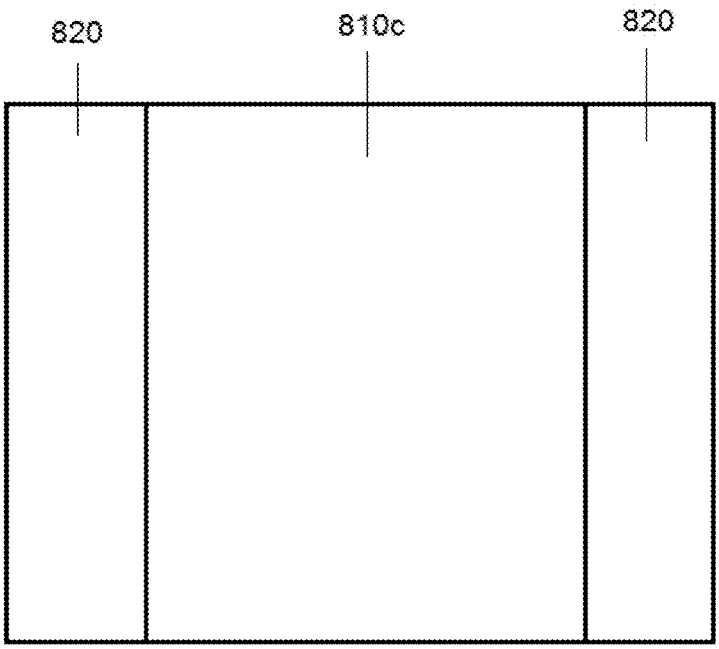

Referring to FIGS. 8(*a*) and 8(*b*), and according to another embodiment, there is shown a thermal break 800 suitable for use in exterior walls for tilt-up construction. Thermal break 800 comprises an elongate body 810 comprising a first surface 810*a* and an opposite second surface 810*b*. In addition, two opposite contacting surfaces 810*c* and 810*d* extend between first surface 810*a* and second surface 810*b*. First surface 810*a* is suitable for mounting a fixture, second surface 810*b* is suitable for mounting or contacting an insulating material, contacting surface 810*c* is suitable for contacting a fascia wythe, and contacting surface 810*d* is suitable for contacting a structural wythe. Thermal break 800 further comprises first protrusions 820 which couple to and extend away from contacting surface 810*c*, and second protrusions 830 which couple to and extend away from contacting surface 810*d*. First protrusions 820 and second protrusions 830 extend in opposite directions away from the elongate body 810. In this embodiment, first protrusions 820 and second protrusions 830 are flanges.

As depicted in FIGS. 8(*a*) and 8(*b*), a first pair of flanges 820, 830 at one end of the elongate body 810 form a rectangular prism comprising surface 810*b*, and a second pair of flanges 820, 830 at the other end of the elongate body 810 form a rectangular prism comprising fixture-mounting surface 810*a* such that thermal break 800 has a cross-sectional shape of an "I" when cut along a plane that is perpendicular to contacting surfaces 810*c* and 810*d*. However, in other embodiments, flanges 820, 830 may not be positioned at the ends of the elongate body 810. In other embodiments, a plurality of flanges 820 may be arranged in a row on contacting surface 810*c*, or randomly on contacting surface 810*c*. Second flanges 830 may have the same or different arrangement on contacting surface 810*d* as first flanges 820 on contacting surface 810*c*.

As depicted in FIGS. 8(*a*) and 8(*b*), flanges 820, 830 are shaped as rectangular prisms. However, in other embodiments, flanges 820, 830 may be any suitable shape such as, but not limited to, a semi-cylinder or other geometric prism. In FIGS. 8(*a*) and 8(*b*), flanges 820, 830 are depicted as extending orthogonally away from contacting surfaces 810*c* and 810*d* respectively. However, in other embodiments, flanges 820, 830 may extend away from contacting surfaces 810*c* and 810*d* respectively in a non-orthogonal manner.

Figure 9A:
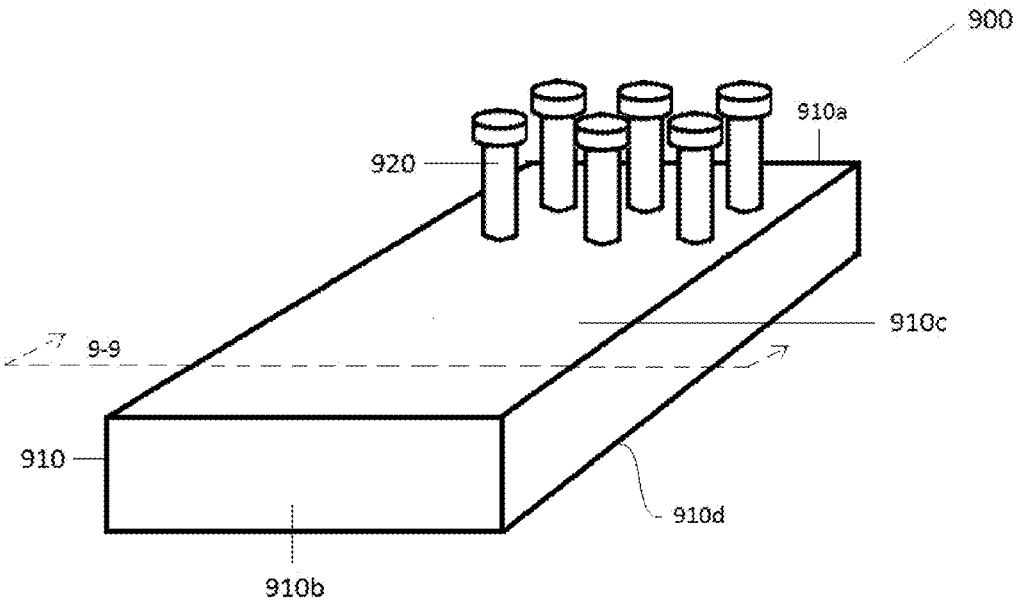
FIG. 9(*a*) is a perspective view of a thermal break according to another embodiment, the thermal break comprising protrusions extending from a surface of the thermal break elongate body, the thermal break further comprising an additional insulating material within the elongate body.
Figure 9B:
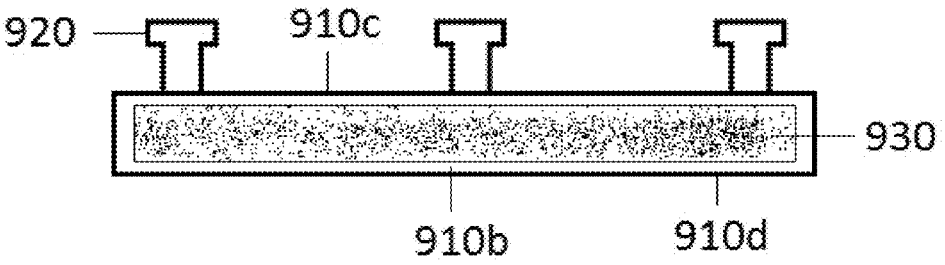
Figure 10A:
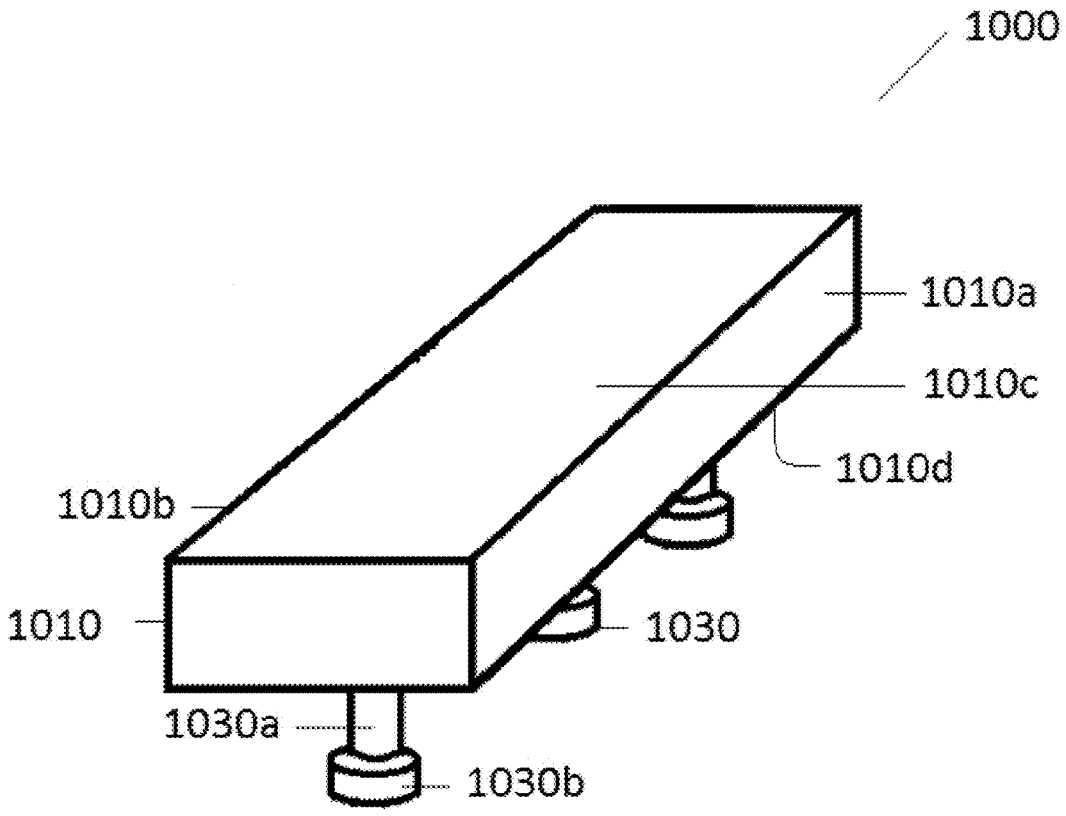
FIG. 10(*a*) is a perspective view of a thermal break according to another embodiment, the thermal break comprising an elongate body, and protrusions extending from a surface of the elongate body.
Figure 10B:
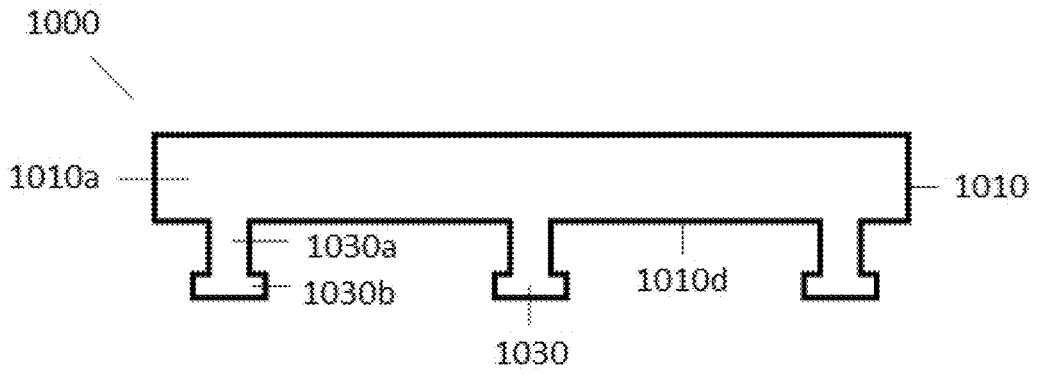
Figure 10C:
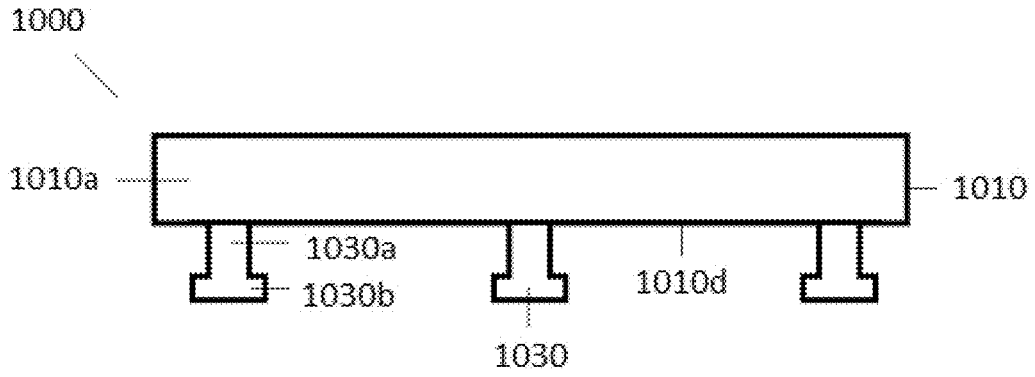
Figure 10D:
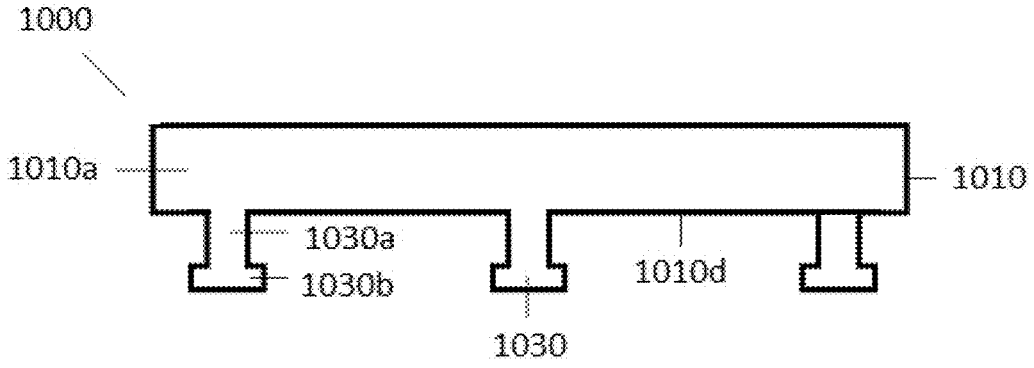
Figure 11A:
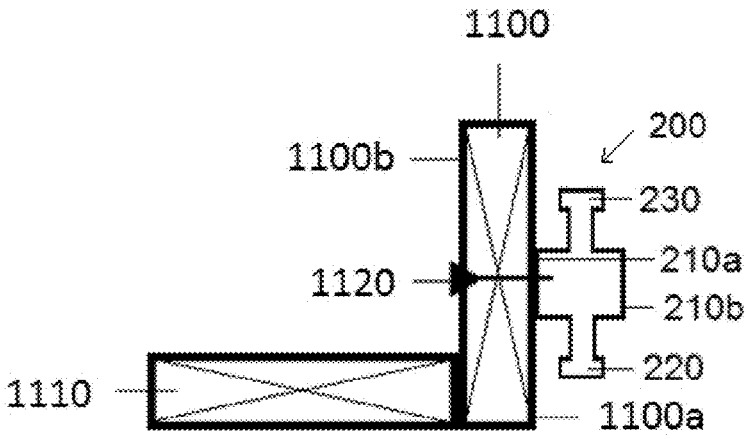
FIGS. 11(*a*), 11(*b*), and 11(*c*) are side views of the thermal break according to FIG. 2(*a*) coupled to wood formwork in a process for constructing a tilt-up exterior wall.
Figure 11B:
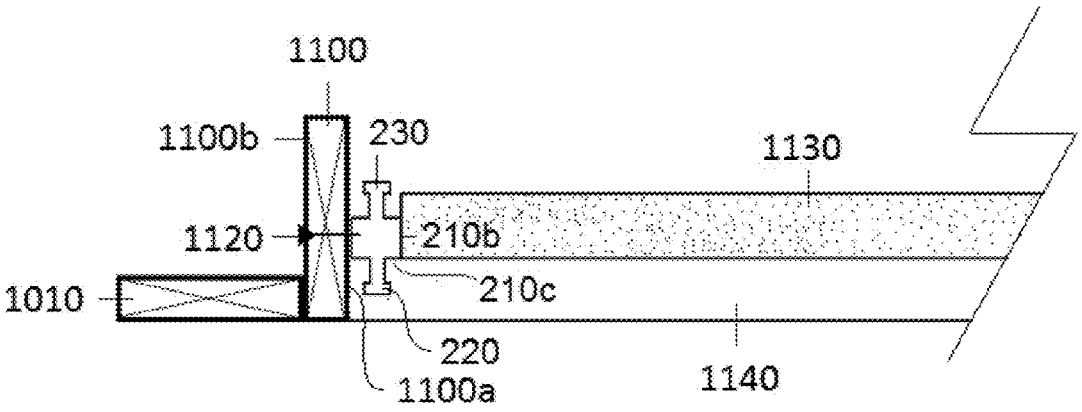
Figure 11C:
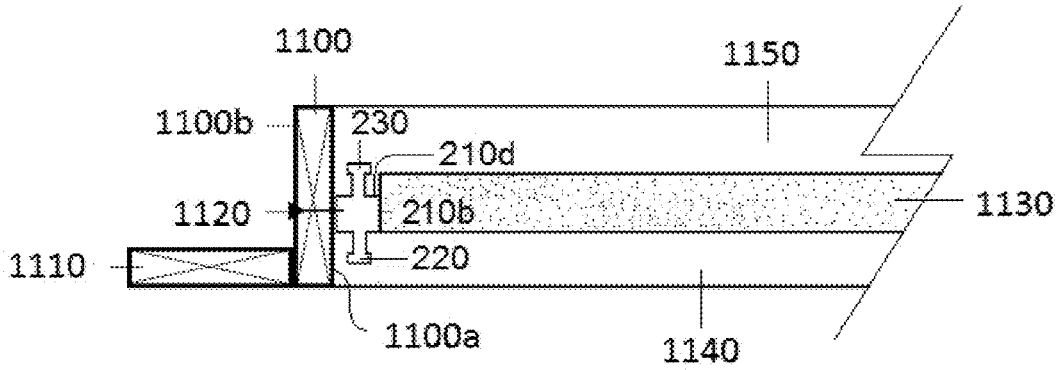
Figure 11D:
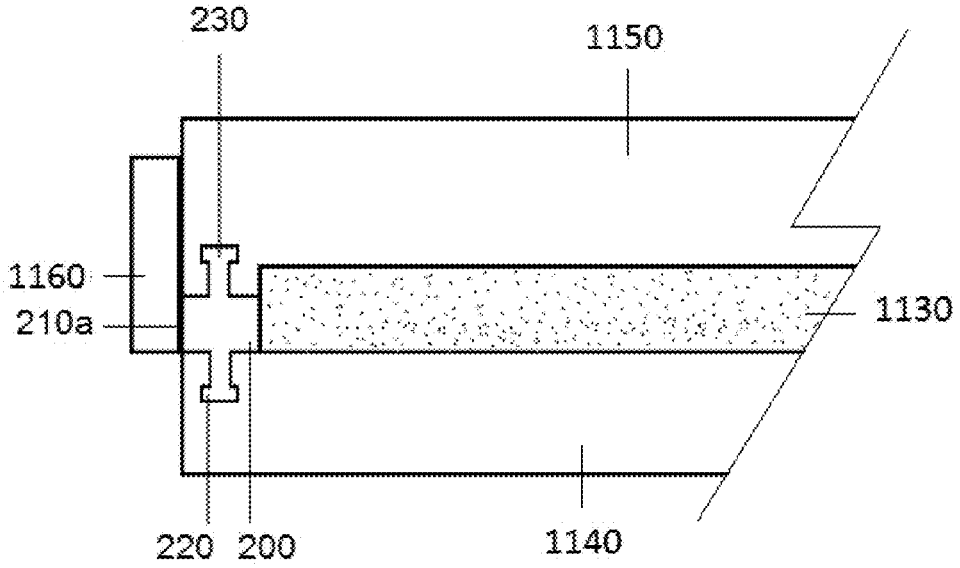
Figure 12A:
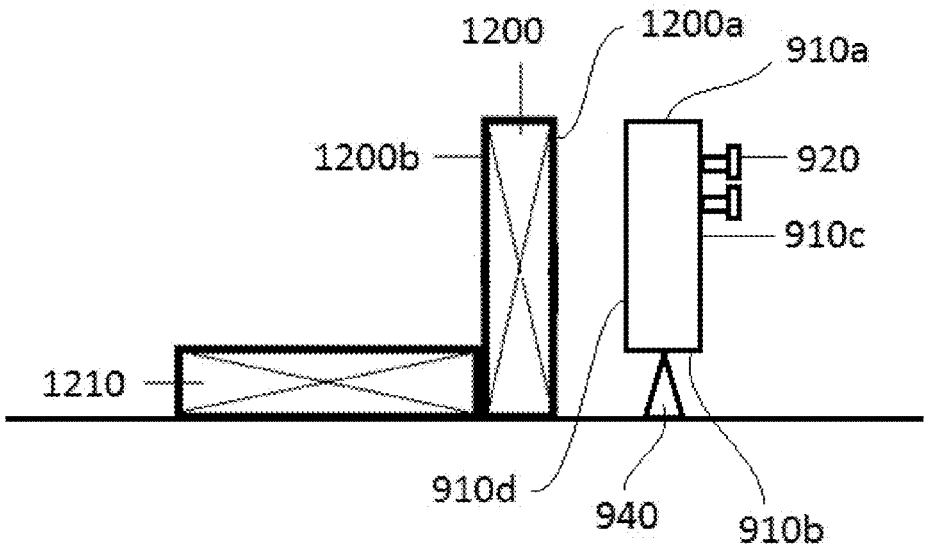
FIGS. 12(*a*), 12(*b*), 12(*c*), and 12(*d*) are side views of the thermal break according to FIG. 9(*a*) in a process for constructing a tilt-up exterior wall.
Figure 12B:
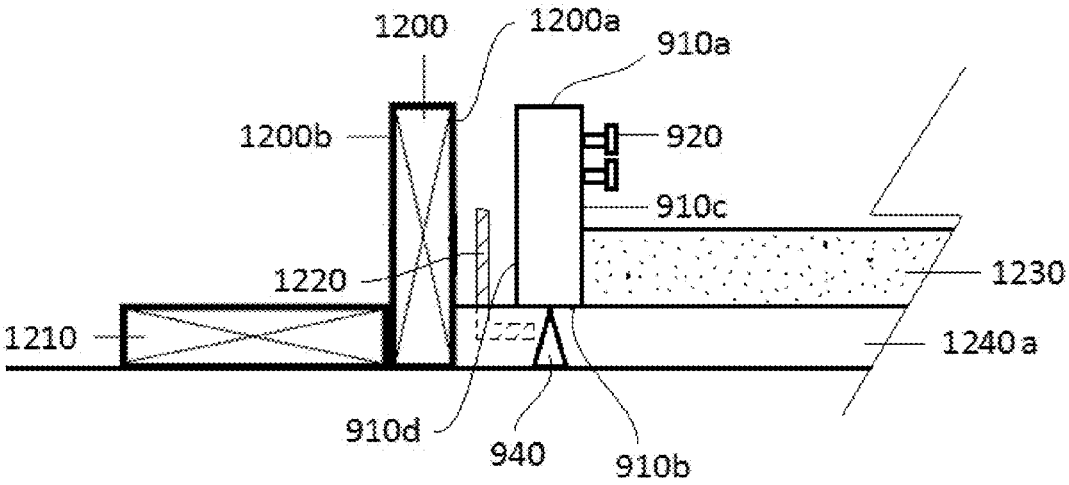
Figure 12C:
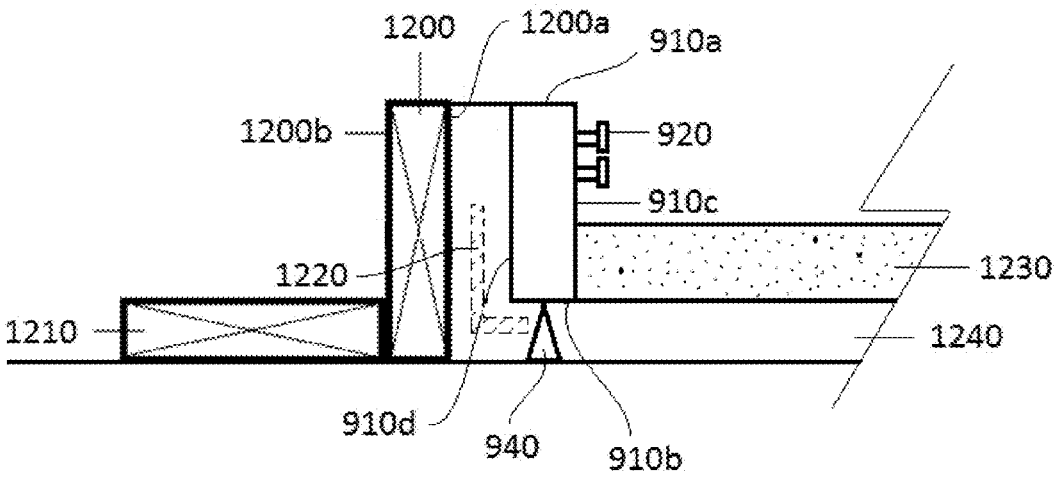
Figure 12D:
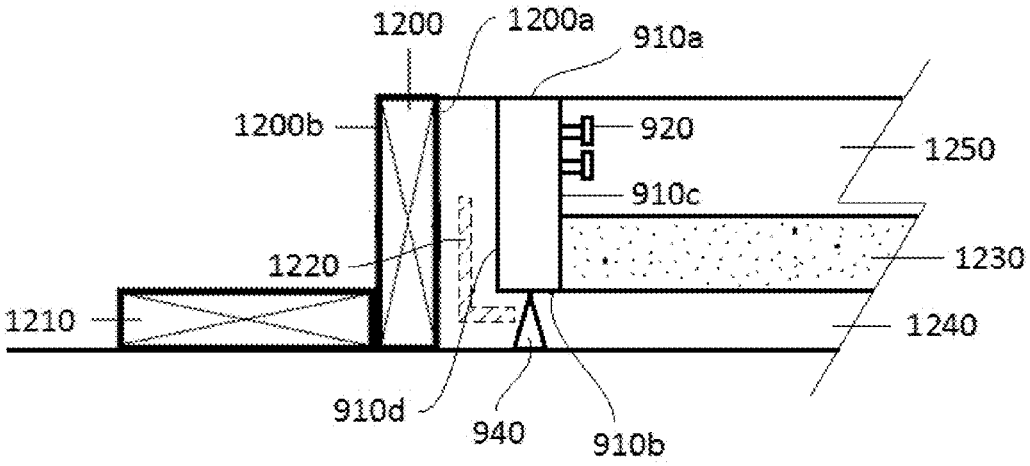
Figure 12E:
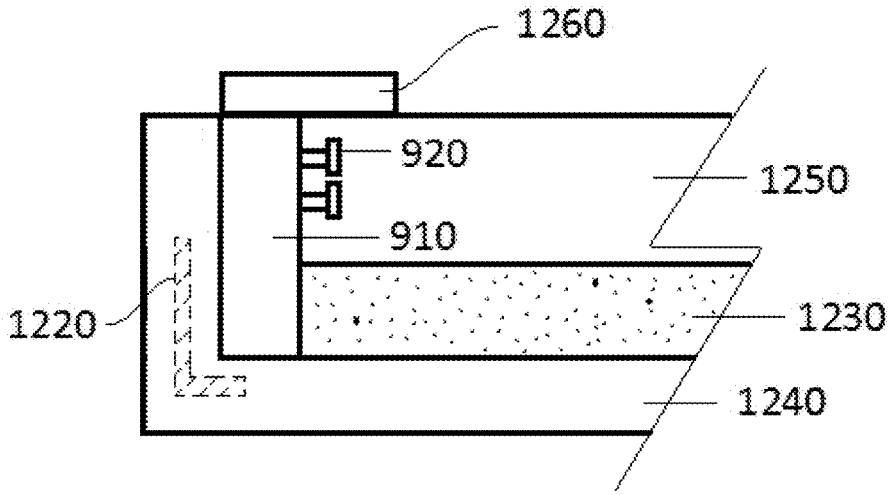
Figure 13A:
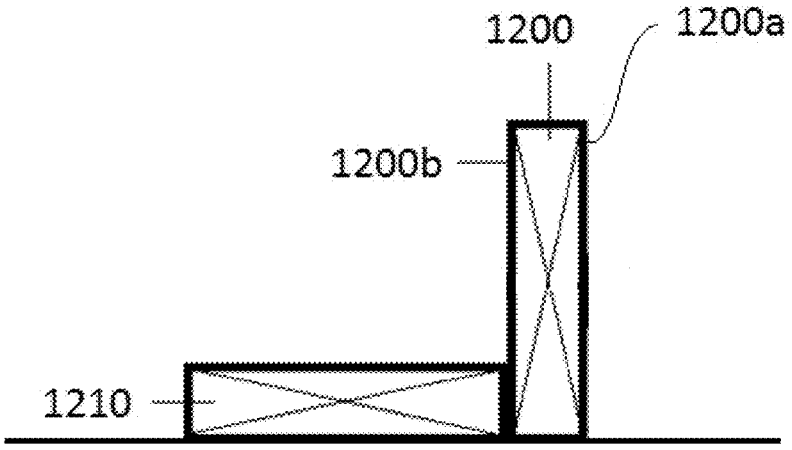
FIGS. 13(*a*), 13(*b*), 13(*c*), and 13(*d*) are side views of a process for constructing a tilt-up exterior wall comprising the thermal break according to FIG. 9(*a*).
Figure 13B:
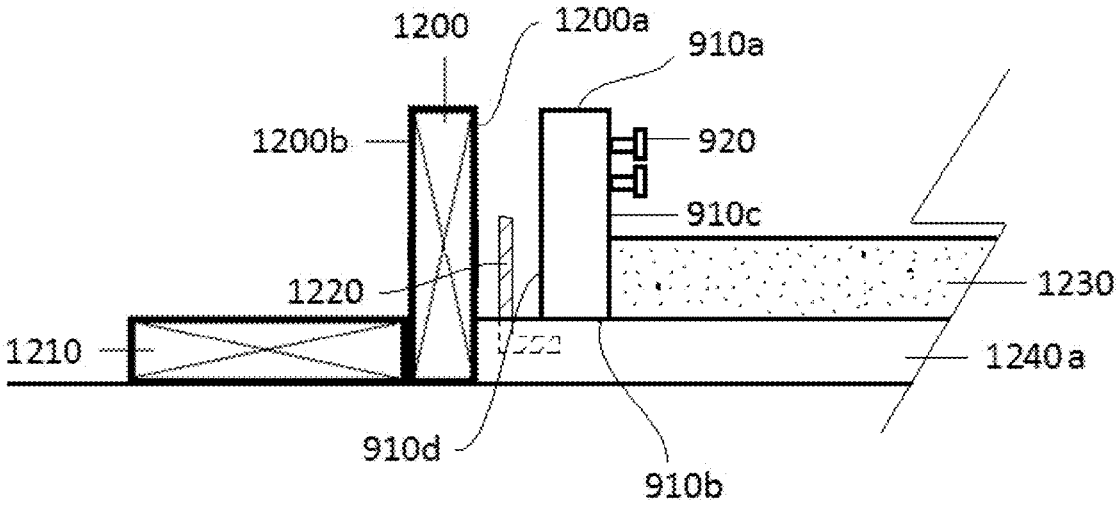
Figure 13C:
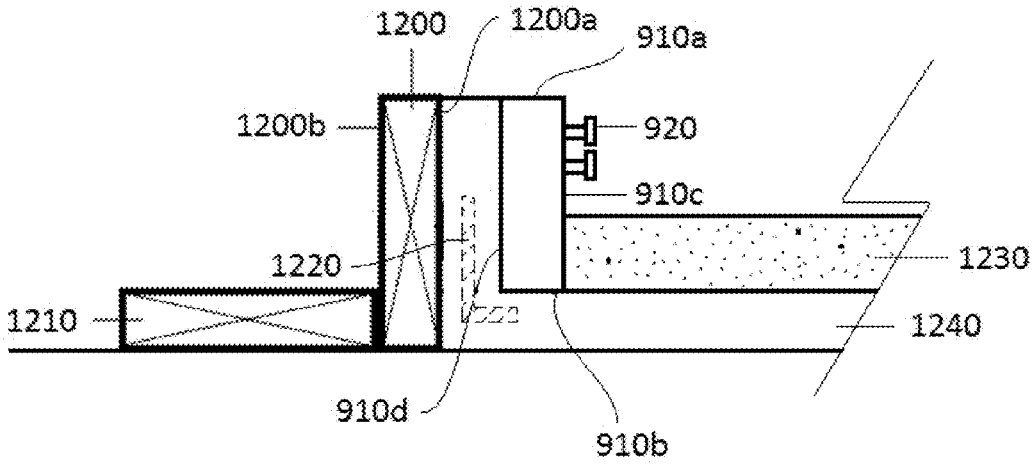
Figure 13D:
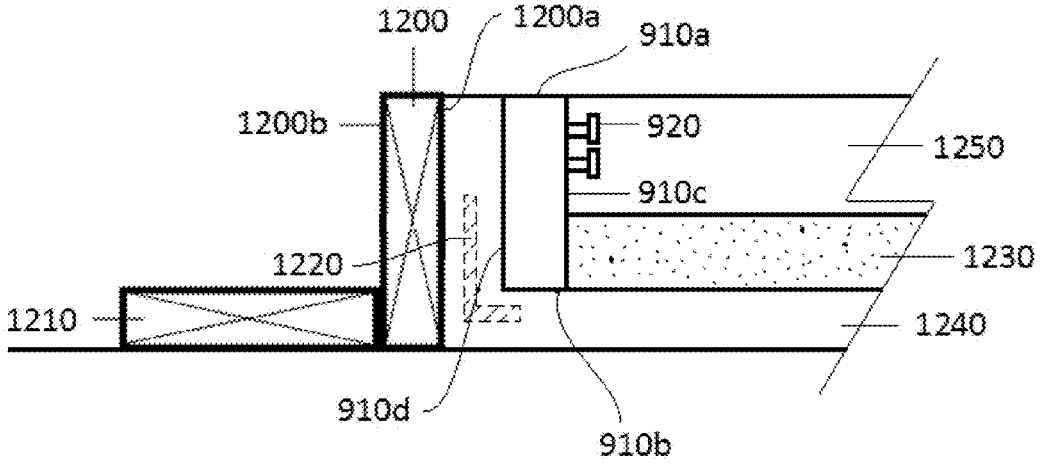

Referring to FIGS. 9(*a*) and 9(*b*), and according to another embodiment, there is shown a thermal break 900 suitable for use in exterior walls for tilt-up construction. Thermal break 900 comprises an elongate body 910 comprising a first surface 910*a* and an opposite second surface 910*b*. In addition, two opposite contacting surfaces 910*c* and 910*d* extend between surfaces 910*a* and 910*b*. First surface 910*a* is suitable for mounting a fixture, second surface 910*b* is suitable for contacting a fascia wythe, contacting surface 910*c* is suitable for mounting or contacting an insulation material that is exterior to the elongate body 910 and contacting a structural wythe, and contacting surface 910*d* is suitable for contacting the fascia wythe. One or more protrusions 920 are coupled to and extend away from contacting surface 910*c*. As depicted in FIG. 9(*a*), six protrusions 920 arranged in two rows of three extend away from contacting surface 910*c*. However, in other embodiments, one or more protrusions in any orientation known to a person skilled in the art may extend away from contacting surface 910*c*.

Referring to FIG. 9(*a*), protrusions 920 are formed from the same material as elongate body 910 and are integrally formed with elongate body 910 such that thermal break 900 is one continuous piece. Alternatively, protrusions 920 are not integrally formed with elongate body 910. Instead, protrusions 920 are coupled to elongate body 910 by methods known in the art. Alternatively, at least one protrusion 920 is integrally formed with elongate body 910, and at least one protrusion 920 is not. In other embodiments, protrusions 920 are made of a material (e.g. metal, metal alloy, insulating material; or a plastic) that is different from the insulating material of elongate body 910.

Referring to FIG. 9(*b*), the interior of the thermal break body 910 comprises an insulating material 930. As contemplated in this embodiment, insulating material 930 is the same material as the insulation material placed in between the fascia wythe and the structural wythe of the exterior wall. Insulating material impedes the loss of thermal energy through the thermal break. In other embodiments, the insulating material 930 is different from the insulation material placed in between the fascia wythe and the structural wythe of the exterior wall.

As described in greater detail below, during "tilt-up" construction of an exterior wall, surfaces 910*b* and 910*d* contact against the fascia wythe. A portion of surface 910*c* is in contact with the insulation material existing between the fascia wythe and the structural wythe. Wet concrete forming the structural wythe contacts at least a portion of the surface 910*c*, and one or more protrusions 920 are immersed in the wet concrete forming the structural wythe of the exterior wall. One or more protrusions 920 anchor the thermal break 900 to the structural wythe.

Referring to FIGS. 10(*a*) to 10(*d*), and according to another embodiment, there is shown a thermal break 1000 suitable for use in exterior walls for tilt-up construction. Thermal break 1000 comprises an elongate body 1010 comprising a first surface 1010*a* and an opposite second surface 1010*b*. In addition, two opposite contacting surfaces 1010*c* and 1010*d* extend between first surface 1010*a* and second surface 1010*b*. First surface 1010*a* is suitable for mounting a fixture, second surface 1010*b* is suitable for mounting or contacting an insulating material, contacting surface 1010*c* is suitable for contacting a fascia wythe, and contacting surface 1010*d* is suitable for contacting a structural wythe. Protrusions 1030 are coupled to and extend away from contacting surface 1010*d*. As facia wythes generally comprise substantially planar surfaces, the contacting surface 1010*c* is also substantially planar so that the fascia wythe may contract, expand, or move relative to the contacting surface 1010*c*, and therefore relative to the thermal break 1000 as well. To avoid the fascia wythe from locking or engaging the contacting surface 1010*c*, the contacting surface 1010*c* does not comprise protrusions extending therefrom or indentations extending therein.

Protrusions 1030 each comprise an elongate extension 1030*a* and a head 1030*b*. Extensions 1030*a* separate the elongate body 1010 from heads 1030*b*. Extensions 1030*a* are depicted in FIGS. 10(*a*) to 10(*d*) as cylindrical. However, in other embodiments, extensions 1030*a* may be any suitable shape such as, but not limited to, a geometric prism, a frustum or an inverted frustum. Heads 1030*b* are depicted as cylindrical in FIGS. 10(*a*) to 10(*d*), and have a greater cross sectional area than extensions 1030*a*. In other embodiments, head 1030*b* may be any suitable shape such as, but not limited to, a sphere, an ovoid, or a square or geometric prism. In FIGS. 10(*a*) to 10(*d*), protrusions 1030 are depicted as extending orthogonally away from contacting surface 1010*d*. However, in other embodiments, protrusions 1030 may extend away from contacting surface 1010*d* in a non-orthogonal manner.

Referring to FIG. 10(*b*), protrusions 1030 are formed from the same material as elongate body 1010 and are integrally formed with elongate body 1010 such that thermal break 1000 is one continuous piece. Alternatively, and as depicted in FIG. 10(*c*), protrusions 1030 are not integrally formed with elongate body 1010. Instead, protrusions 1030 are coupled to elongate body 1010 by methods known in the art. Alternatively, and as depicted in FIG. 10(*d*), one or more protrusions 1030 are integrally formed with elongate body 1010, while one or more protrusions 1030 are not integrally formed with elongate body 1010. In other embodiments, protrusions 1030 are made of a material (e.g. metal, metal alloy, or a plastic) that is different from the material of elongate body 1010.

As contemplated in this embodiment, protrusions 1030 are arranged in a row on contacting surface 1010*d* of elongate body 1010. In other embodiments, protrusions 1030 may be arranged in any arrangement, for example in two or more rows on contacting surface 1010*d* of elongate body 1010, or randomly on contacting surface 1010*s* of elongate body 1010.

During "tilt-up" construction of an exterior wall, wet concrete contacts contacting surface 1010*c* and sets to form the fascia wythe of the exterior wall. The fascia wythe may move relative to the contacting surface 1010*c*. Wet concrete also contacts contacting surface 1010*d*, immerses protrusions 1030, and sets to form the structural wythe of the exterior wall. Heads 1030*b* anchor the thermal break 1000 to the structural wythe.

Thermal break 900, 1000 contact and anchor into the structural wythe, and contact but do not anchor into the fascia wythe. Such a configuration accommodates the different rates of expanding and contracting of the thermal break and the fascia wythe, thereby minimizing structural damage to either one of the fascia wythe and thermal break over time.

Elongate body 210, 310, 410, 510, 610, 710, 810, 910, 1010 is constructed of at least one thermal insulating material providing a weight-bearing surface capable of at least partially supporting the weight of a mounted fixture against the pull of gravity. Such fixtures include, but are not limited to, a pre-fabricated industrial grade door frame, window frame, air venting grill, or other building components used to provide an opening through an exterior wall of a building. As contemplated in the embodiments depicted in FIGS. 2 to 10, elongate body 210, 310, 410, 510, 610, 710, 810, 910, 1010 is substantially made of a non-wood based material that is suitable for contacting wet concrete, cured concrete, and insulating material. As contemplated in the embodiments depicted in FIGS. 2 to 10, elongate body 210, 310, 410, 510, 610, 710, 810, 910, 1010 is manufactured of a polyvinyl chloride (PVC) material, such as expanded closed-cell polyvinyl chloride (PVC) foam. However, in other embodiments, the elongate body may be made of fibreglass or a suitable plastic material such as an extrudable thermoplastic material, or high-density polyethylene. In other embodiments, the elongate body manufactured substantially of PVC foam, or fibreglass, or suitable plastic material, or high-density polyethylene, has included within it any one of or a combination of wood, glass, and metal fibres to further improve the structural integrity of the thermal break elongate body. As contemplated in the embodiment depicted in FIGS. 2 to 6 and 8-10, elongate body 210, 310, 410, 510, 610, 810, 910, 1010 is shaped like a rectangular prism. However, in other embodiments, elongate body may be shaped in any suitable form or dimensions.

Elongate body 210, 310, 410, 510, 610, 710, 810, 910, 1010 of the thermal break 200, 300, 400, 500, 600, 700, 800, 900, 1000 may be any suitable dimensions, and the dimensions of elongate body 210, 310, 410, 510, 610, 710, 810, 910, 1000 may depend on the dimensions of the fixture which is to be mounted to fixture-mounting surface 210*a*, 310*a*, 410*a*, 510*a*, 610*a*, 710*a*, 810*a*, 910*a*, 1010*a* of the elongate body 210, 310, 410, 510, 610, 710, 810, 910, 1010 when in use. Preferably, elongate body 210, 310, 410, 510, 610, 710, 810, 910, 1010 is of dimensions such that spalling does not occur. Any suitable number of protrusions may extend from the elongate body of the thermal break. The number of protrusions extending from the elongate body may depend on the dimensions of the elongate body and the optimal spacing of the protrusions to provide good anchorage of the thermal break to the structural wythe and/or fascia wythe of the exterior wall. In other embodiments one or more protrusions extend from any one or both of the contacting surfaces of the thermal break.

Thermal Break Manufacture

Using an expanded closed-cell polyvinyl chloride foam thermal break as an example, polyvinyl chloride and polyurea may be mixed together under controlled conditions, which are known to a person skilled in the art. The mixture is then poured into a mold, and the filled mold is sealed. The sealed mold is then placed into a large press where it is heated. The resulting solid material is removed from the mold, and soaked in a hot bath where the resulting solid material is allowed to expand to its desired final density. The solid material is then cured, and the cured expanded closed-cell polyvinyl chloride foam material is cut into its desired dimensions. As would be known to a person skilled in the art, the mold may dictate the general shape of the thermal break, and may dictate which components of the thermal break are integrally formed together.

Exterior Wall Manufacture Using Thermal Break 200—Example 1

Using thermal break 200 as an example, thermal break 200 may be incorporated into a "tilt-up" exterior wall in the following manner. Referring to FIGS. 11(*a*) to 11(*d*), a pre-defined area is marked by placement of lumber 1100 marking the perimeter of the desired exterior wall. Lumber 1100 is positioned such that inside face-side 1100*a* faces towards the desired exterior wall and outside face-side 1100*b* faces away from the desired exterior wall. A supporting piece of lumber 1110 is placed at the base of lumber 1100 and against outside face side 1100*b*, and lumbers 1100 and 1110 are joined together by one or more fasteners such as, but not limited to, a nail, screw, strut, connecting piece of wood, or the like, to maintain the upright position of lumber 1100. The combination of lumber 1100, lumber 1110, and the one or more fasteners joining lumbers 1100 and 1110 together, collectively forms the formwork. Welded wire mesh (not shown) is then laid out within the boundaries of the formwork and over the pre-defined area.

Using a fastener 1120, for example a screw or nail, the thermal break 200 is mounted onto inside face-side 1100*a* of lumber 1100 with fixture-mounting surface 210*a* of the elongate body 210 extending along the inside face-side

1100*a* of lumber 1100. The thermal break 200 may be installed before or after the welded wire mesh is laid out. Referring to FIG. 11(*b*), a first layer of wet concrete (forming the fascia wythe 1140 of the exterior wall) is poured within the pre-defined area and over the welded wire mesh until the first protrusions 220 of the thermal break 200 are immersed in wet concrete and the wet concrete contacts contacting surface 210*c* of the elongate body 210. The elongate body 210 of the thermal break 200 is contiguous with the top of the first layer of wet concrete, but not immersed in the first layer of wet concrete. Before the wet concrete sets, insulating material 1130 is positioned over the first layer of wet concrete with the end face of the insulating material 1130 being contiguous with surface 210*b* of thermal break 200. The insulating material 1130 is coupled with the first layer of wet concrete using methods known in the art. As depicted in FIG. 11(*b*), the width of insulating material 1130 is greater than the width of surface 210*b* of thermal break 200. Alternatively, the width of insulating material 1130 and the width of surface 210*b* of thermal break 200 are the same. Alternatively, the width of surface 210*b* of thermal break 200 is greater than the width of insulating material 1130.

Once the first layer of wet concrete has set, thereby forming fascia wythe 1140, reinforcing bars (not shown) are laid out over insulating material 1130 and thermal break 200. Referring to FIG. 11(*c*), a second layer of wet concrete (forming the structural wythe 1150 of the exterior wall) is then poured over the reinforcing bars, insulating material 1130, and thermal break 200 such that the second protrusions 230 are completely immersed in wet concrete and the wet concrete contacts contacting surface 210*d* of elongate body 210. The insulating material 1130 is coupled to the second layer of wet concrete using methods known in the art. The second layer of wet concrete sets to form the structural wythe 1150 of the exterior wall.

Fastener 1120 and the formwork (i.e. the combination of lumber 1100, lumber 1110, and the one or more fasteners joining lumbers 1100 and 1110 together) are then removed. Referring to FIG. 11(*d*), a fixture 1160, for example a door frame, window frame, air venting grill, or other building component, is mounted on fixture-mounting surface 210*a* of thermal break 200 and on at least a portion of structural wythe 1150. Alternatively, the fixture 1160 may be mounted on fixture-mounting surface 210*a* of elongate body 210 of thermal break 200 only, and without being mounted to the structural wythe 1150. A crane may be used to tilt the exterior wall with fixture 1160 mounted thereon from a horizontal position to a vertical position and to move the exterior wall to its desired position. Alternatively, the exterior wall may be tilted from a horizontal position to a vertical position and positioned correctly before fixture 1160 is mounted on fixture-mounting surface 210*a* of thermal break 200.

An exterior wall comprising a thermal break 1000 may be similarly manufactured, except that no protrusions are immersed in the fascia wythe. Because contacting surface 1010*c* is substantially planar, no part of the fascia wythe extends orthogonally beyond the axis along which contacting surface 1010*c* extends.

Exterior Wall Manufacture Using Thermal Break 700

Using thermal break 700 as depicted in FIG. 7(*a*) as an example, thermal break 700 may be incorporated into a "tilt-up" exterior wall in the following manner. A formwork is constructed at the boundary of the pre-defined area as discussed above. Welded wire mesh (not shown) is then laid out within the boundaries of the formwork and over the pre-defined area.

Using a fastener, for example a screw or nail, thermal break 700 is mounted onto the inside face-side the first lumber with fixture-mounting surface 710*a* of elongate body 710 extending along the inside face side of the first lumber. Thermal break 700 may be installed before or after the welded wire mesh is laid out. A first layer of wet concrete (forming the fascia wythe of the exterior wall) is then poured within the pre-defined area and over the welded wire mesh until the wet concrete contacts contacting surface 710*c* of elongate body 710. Elongate body 710 of thermal break 700 is contiguous with the top of the first layer of wet concrete, but not immersed in the first layer of wet concrete. Before the wet concrete sets, insulating material is positioned over the first layer of wet concrete with the end face of the insulating material being contiguous with surface 710*b* of thermal break 700. The insulating material is coupled with the first layer of wet concrete using methods known in the art.

Once the first layer of wet concrete has set, thereby forming the fascia wythe, reinforcing bars are laid out over the insulating material and thermal break 700. A second layer of wet concrete is then poured over the reinforcing bars, the insulating material, and thermal break 700 such that the wet concrete contacts contacting surface 710*d* of elongate body 710. The insulating material is coupled to the second layer of wet concrete using methods known in the art. The second layer of wet concrete sets to form the structural wythe of the exterior wall.

The fastener and the formwork are then removed. A fixture, for example a door frame, window frame, air venting grill, or other building component, is mounted on fixture-mounting surface 710*a* of thermal break 700 and on at least a portion of the structural wythe. Alternatively, the fixture may be mounted on fixture-mounting surface 710*a* of thermal break 700 only, and without being mounted to the structural wythe. A crane may be used to tilt the exterior wall with the fixture mounted thereon from a horizontal position to a vertical position and to move the exterior wall to its desired position. Alternatively, the exterior wall may be tilted from a horizontal position to a vertical position and positioned correctly before the fixture is mounted on fixture-mounting surface 710*a* of thermal break 700.

Exterior Wall Manufacture Using Thermal Break 900—Example 1

Using thermal break 900 as an example, thermal break 900 may be incorporated into a "tilt-up" exterior wall in the following manner. Referring to FIGS. 12(*a*) to 12(*d*), a pre-defined area is marked by placement of lumber 1200 marking the perimeter of the desired exterior wall. Lumber 1200 is positioned such that inside face-side 1200*a* faces towards the desired exterior wall and outside face-side 1200*b* faces away from the desired exterior wall. A supporting piece of lumber 1210 is placed at the base of lumber 1200 and against outside face side 1200*b*, and lumbers 1200 and 1210 are joined together by one or more fasteners such as a nail, screw, strut, connecting piece of wood, or the like, to maintain the upright position of lumber 1200. The combination of lumber 1200, lumber 1210, and the one or more fasteners joining lumbers 1200 and 1210 together, collectively forms the formwork. Welded wire mesh (not shown) is then laid out within the boundaries of the formwork and over the pre-defined area.

One or more supporting bases 940 extends along the length of surface 910*b*, the one or more supporting bases 940 supporting the thermal break 900 in mid-air within the boundaries of the formwork. Referring to FIG. 12(*b*), a first layer of wet concrete 1240*a* (forming a portion of the fascia wythe 1240 of the exterior wall) is poured within the pre-defined area and over the welded wire mesh until the one or more supporting bases 940 is immersed in wet concrete and the wet concrete layer 1240*a* contacts contacting surface 910*b* of the elongate body 910. The elongate body 910 of the thermal break 900 is contiguous with the top of the first layer of wet concrete 1240*a*, but not immersed in the first layer of wet concrete 1240*a*. Before the wet concrete layer 1240*a* sets, insulating material 1230 is positioned over the first layer of wet concrete 1240*a* with the end face of the insulating material 1230 being contiguous with surface 910*c* of thermal break 900. The insulating material 1230 is coupled with the first layer of wet concrete 1240*a* using methods known in the art. As depicted in FIG. 12(*b*), a reinforcing bar 1220 is immersed in the first layer of wet concrete 1240*a*, the reinforcing bar 1220 for providing additional stability to the fascia wythe 1240, and particularly the corner of the fascia wythe 1240.

Referring to FIG. 12(*c*), a second layer of wet concrete (not numbered) is poured between the lumber 1200 and surface 910*d* of thermal break 900 and onto the first layer of wet concrete 1240*a*, after the first layer of wet concrete 1240*a* has set. Upon curing of the second layer of wet concrete and the first layer of wet concrete 1240*a*, the fascia wythe 1240 (which is reinforced at the corner by reinforcing bar 1220) is formed.

Reinforcing bars (not shown) are laid out over insulating material 1230. Referring to FIG. 12(*d*), a third layer of wet concrete is poured over the reinforcing bars and insulating material 1230 such that the one or more protrusions 920 are immersed in the third layer of wet concrete and the third layer of wet concrete contacts contacting surface 910*c* of elongate body 910. The insulating material 1230 is coupled to the third layer of wet concrete using methods known in the art. The third layer of wet concrete sets to form the structural wythe 1250 of the exterior wall.

The formwork is removed, and the exterior wall is tilted-up. The one or more supporting bases 940 are removed by methods known in the art, and the remaining spatial voids are filled in with concrete or an alternative filling material that is known in the art. Referring to FIG. 12(*d*), a fixture 1260, for example a door frame, window frame, air venting grill, or other building component, is mounted on fixture-mounting surface 910*a* of thermal break 900 and on at least a portion of structural wythe 1250. Alternatively, the fixture 1260 may be mounted on fixture-mounting surface 910*a* of elongate body 910 of thermal break 900 only, and without being mounted to the structural wythe 1250.

Exterior Wall Manufacture Using Thermal Break 900—Example 2

Using thermal break 900 as an example, thermal break 900 may be incorporated into a "tilt-up" exterior wall in the following manner. Referring to FIGS. 13(*a*) to 13(*d*), a pre-defined area is marked by placement of lumber 1200 marking the perimeter of the desired exterior wall. Lumber 1200 is positioned such that inside face-side 1200*a* faces towards the desired exterior wall and outside face-side 1200*b* faces away from the desired exterior wall. A supporting piece of lumber 1210 is placed at the base of lumber 1200 and against outside face side 1200*b*, and lumbers 1200 and 1210 are joined together by one or more fasteners such as a nail, screw, strut, connecting piece of wood, or the like, to maintain the upright position of lumber 1200. The combination of lumber 1200, lumber 1210, and the one or more fasteners joining lumbers 1200 and 1210 together, collectively forms the formwork. Welded wire mesh (not shown) is laid out within the boundaries of the formwork and over the pre-defined area.

Referring to FIG. 13(*b*), a first layer of wet concrete 1240*a* (forming a portion of the fascia wythe 1240 of the exterior wall) is poured within the pre-defined area and over the welded wire mesh to a pre-determined height relative to lumber 1200. The first layer of concrete 1240*a* is allowed to set. Thermal break 900 is positioned on top of concrete layer 1240*a*, and at a pre-determined distance away from lumber 1200. Preferably, the elongate body 910 of the thermal break 900 is contiguous with the top of concrete layer 1240*a*, but not immersed in the concrete layer 1240*a*. Insulating material 1230 is positioned over concrete layer 1240*a* with the end face of the insulating material 1230 being contiguous with surface 910*c* of thermal break 900. Preferably, the insulating material 1230 is positioned over the concrete layer 1240*a* before the concrete layer 1240*a* sets, so that the insulating material 1230 may be coupled with the concrete layer 1240*a* using methods known in the art (e.g. wythe ties). Prior to concrete layer 1240*a* setting, a reinforcing bar 1220 is immersed in the first layer of wet concrete 1240*a*. The reinforcing bar 1220 provides additional stability to the fascia wythe 1240, and particularly the corner of the fascia wythe 1240.

Referring to FIG. 13(*c*), a second layer of wet concrete (not numbered) is poured between the lumber 1200 and surface 910*d* of thermal break 900 and onto concrete layer 1240*a*, after concrete layer 1240*a* has set. The second layer of concrete and the concrete layer 1240*a* form the fascia wythe 1240.

Reinforcing bars (not shown) are laid out over insulating material 1230. Referring to FIG. 13(*d*), a third layer of wet concrete 1250 is poured over the reinforcing bars and insulating material 1230 such that the one or more protrusions 920 are immersed in the third layer of wet concrete 1250 and the third layer of wet concrete 1250 contacts contacting surface 910*c* of thermal break 900. The insulating material 1230 is coupled to the third layer of wet concrete 1250 using methods known in the art. The third layer of wet concrete 1250 sets to form the structural wythe 1250.

In other examples (not shown), insulating material 1230 is positioned so that it is ultimately contiguous with concrete layer 1240*a* and the second layer of concrete, and the thermal break 900 is positioned so that at least a portion of surface 910*b* (if not all of surface 910*b*) is contiguous with insulating material 1230, and at least a portion of surface 910*d* (if not all of surface 910*d*) is contiguous with the second layer of concrete.

Insulation Concrete Form Using Thermal Break 1000

Figure 14:
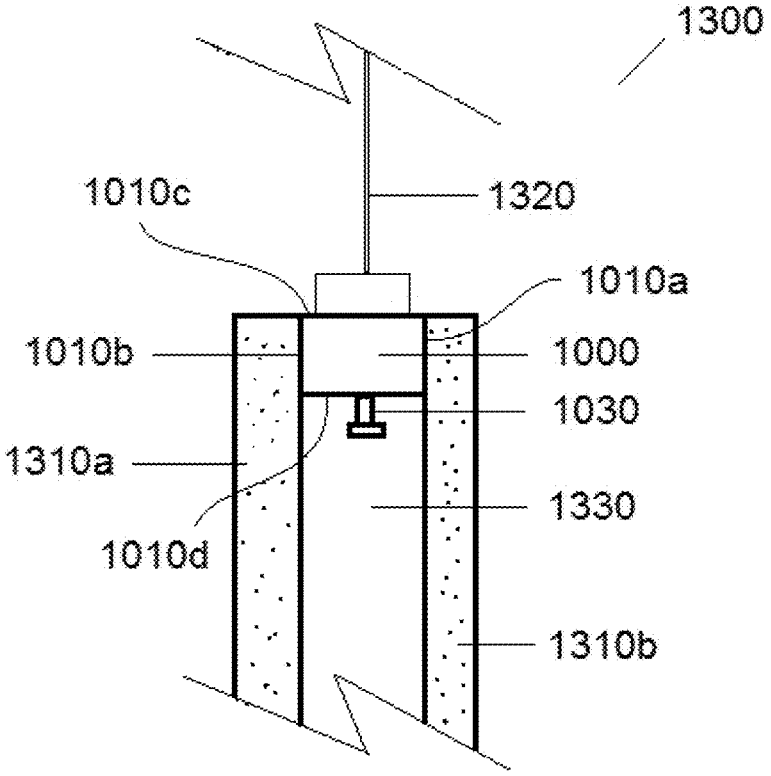
FIG. 14 is a top view of an insulation concrete form comprising a thermal break according to FIG. 10.
Figure 15A:
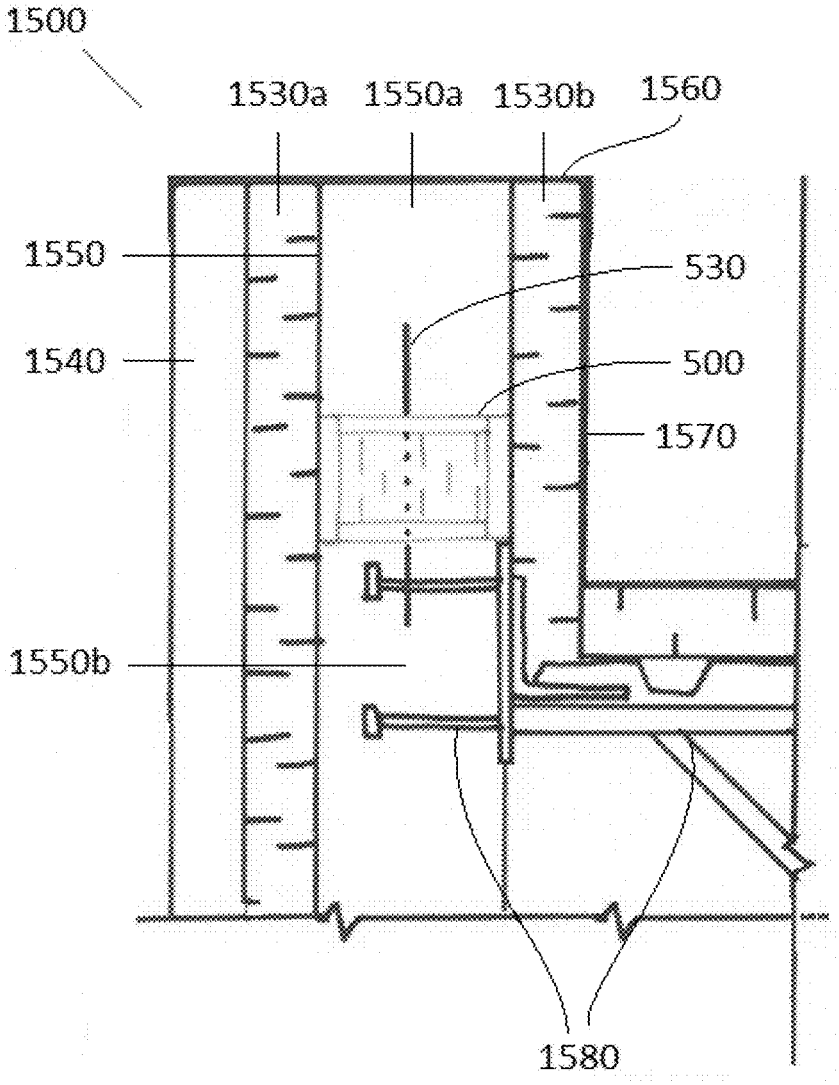
FIGS. 15(*a*) to 15(*g*) relate to a thermal break disposed in a parapet structure of an exterior wall.
Figure 15B:
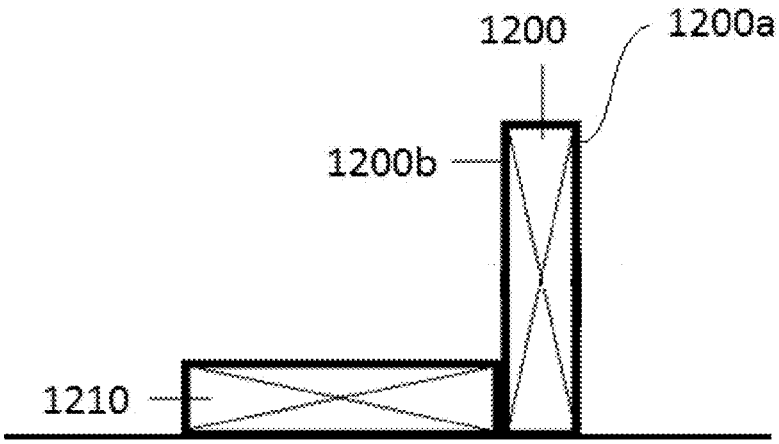
Figure 15C:
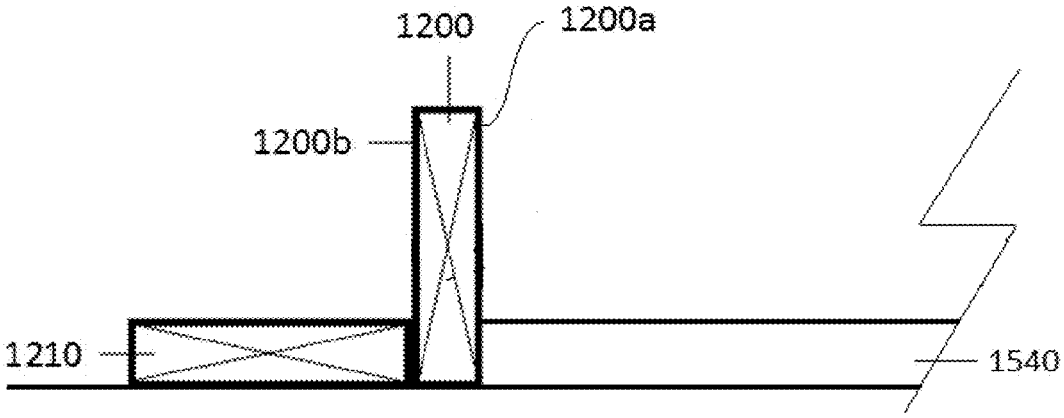
Figure 15D:
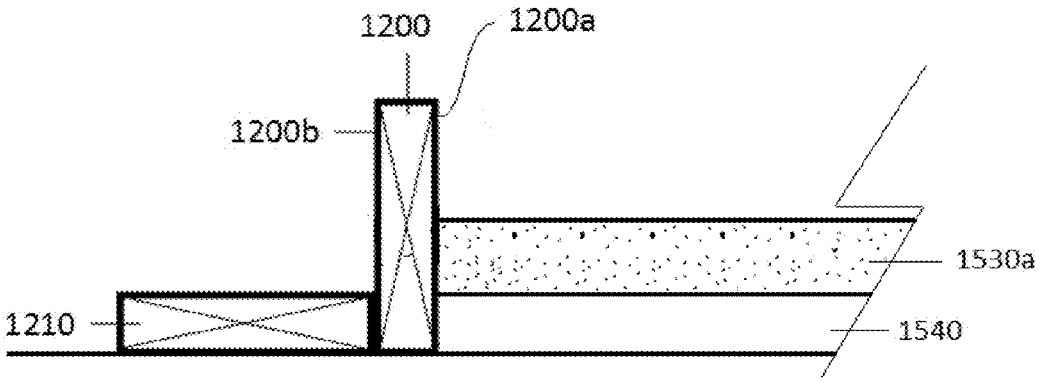
Figure 15E:
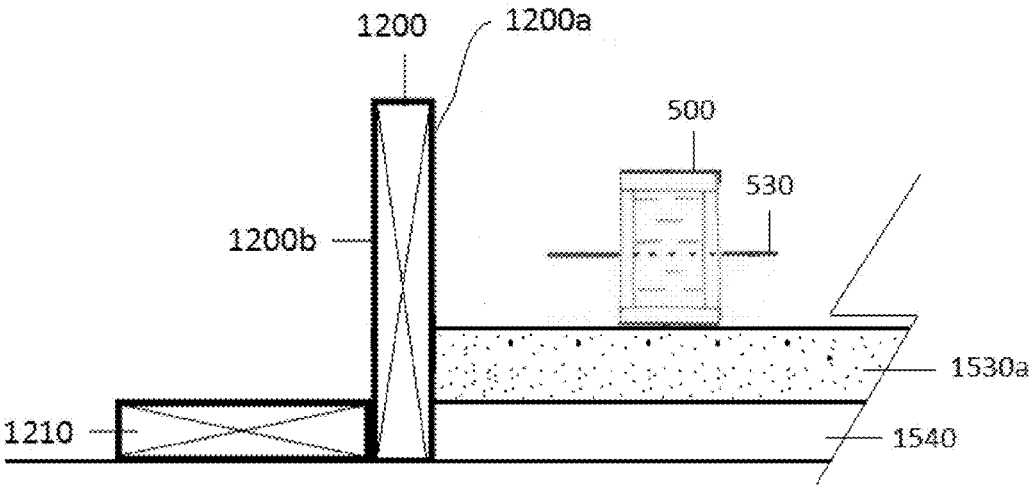
Figure 15F:
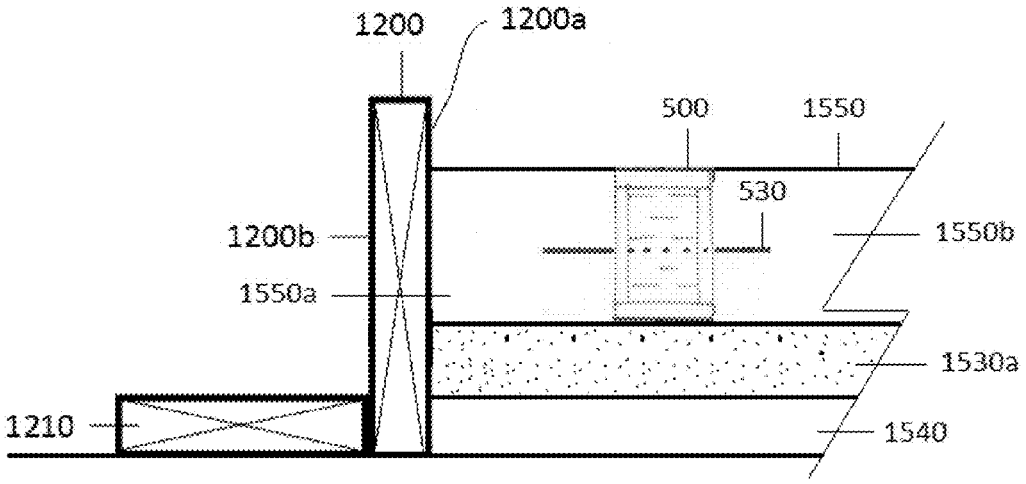
Figure 15G:
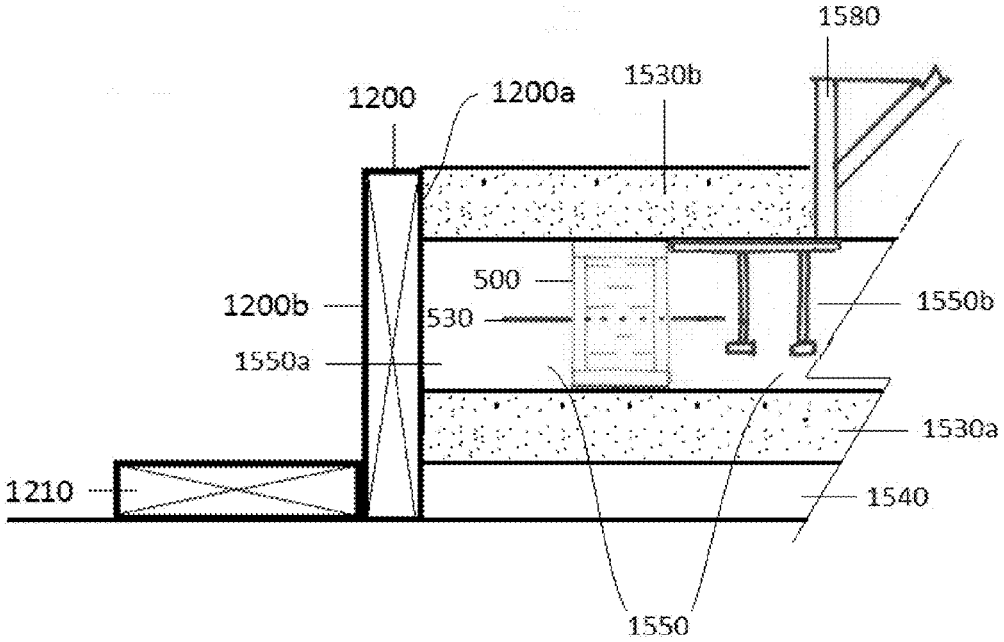

Referring to FIG. 14, insulation materials 1310*a*, 1310*b* (e.g. expanded polystyrene) and thermal break 1000 extending therebetween create a cavity into which concrete layer 1330 is poured and set. As concrete layer 1330 is poured into the cavity, protrusions 1030 become immersed in the concrete layer 1330. Concrete layer 1330 sets to form a concrete wall that is surrounded by insulation materials 1310*a*, 1310*b*. Thermal break 1000 comprises a fixture mounting surface onto which fixture 1320 (e.g. a window) is mounted. Insulation concrete form 1300 is thereby formed.

In this embodiment, the fixture mounting surface 1010*a* and opposite surface 1010*b* are contiguous with the insulation materials 1310*a*, 1310*b*. First contacting surface 1010*c* serves as the fixture-mounting surface for mounting fixture 1320, and second contacting surface 1010*d* (from which one or more protrusions extends) is contiguous with the concrete layer 1330.

Thermal Break Installation in a Parapet Structure

Referring to FIG. 15(*a*), there is a parapet structure 1500 comprising a fascia wythe 1540, a structural wythe 1550 comprising a first portion 1550*a* and a second portion 1550*b*, insulating material 1530*a* disposed between the fascia wythe and the structural wythe 1550, insulating material 1530*b* disposed between the structural wythe 1550 and a roofing membrane 1570, a flashing 1560 disposed at the top of the parapet structure 1500, a thermal break 500 comprising a rod 530, the thermal break 500 contiguous with insulating materials 1530*a* and 1530*b* and separating structural wythe portions 1550*a* and 1550*b*, and a structural wythe support structure 1580 comprising an embed (un-numbered) that is generally known in the art. At least some parapet structures are currently constructed such that continuous insulation at the parapet is maintained by bringing the insulating material up and over the parapet, and tying the insulating material into the roof insulation. Such construction techniques may be time-consuming and/or costly. The parapet structure 1500 disclosed herein provides a continuous insulation arrangement between the structural wythe and fascia wythe as required by some energy codes in a manner that is time-effective and cost-effective for the installer.

Referring to FIG. 15(*b*), a pre-defined area is marked by placement of lumber 1200 marking the perimeter of the desired exterior wall. Lumber 1200 is positioned such that inside face-side 1200*a* faces towards the desired exterior wall and outside face-side 1200*b* faces away from the desired exterior wall. A supporting piece of lumber 1210 is placed at the base of lumber 1200 and against outside face side 1200*b*, and lumbers 1200 and 1210 are joined together by one or more fasteners such as a nail, screw, strut, connecting piece of wood, or the like, to maintain the upright position of lumber 1200. The combination of lumber 1200, lumber 1210, and the one or more fasteners joining lumbers 1200 and 1210 together, collectively forms the formwork. Welded wire mesh (not shown) is laid out within the boundaries of the formwork and over the pre-defined area.

Referring to FIGS. 15(*c*) and 15(*d*), a first layer of wet concrete 1540 is poured within the pre-defined area and over the welded wire mesh to a pre-determined height relative to lumber 1200. The first layer of concrete 1540 is allowed to set and form the fascia wythe 1540. Insulating material 1530*a* is positioned over concrete layer 1540 with the end face of the insulating material 1540 being contiguous with lumber surface 1200*a*. Preferably, the insulating material 1530*a* is positioned over the concrete layer 1540 before the concrete layer 1540 sets. The insulating material is coupled with the concrete layer 1540 using methods known in the art.

Referring to FIG. 15(*e*), a thermal break 500 comprising a rod 530 is disposed on the insulating material 1530*a* at a pre-determined distance away from surface 1200*a* of lumber 1200. As contemplated in this example, rod 530 is made of an insulating material such as, but not limited to, fibre-glass, in order to impart further insulating properties to the parapet structure 1500. Rod 530 serves to stabilize the thermal break 500 in between portions 1550*a* and 1550*b* of the structural wythe 1550, and couple the thermal break 500 to the structural wythe 1550. Rod 530 is coupled to the body of the thermal break 500 as previously described in the disclosure.

Reinforcing bars (not shown) are laid out over insulating material 1530*a*. Referring to FIG. 15(*f*), wet concrete portions 1550*a* and 1550*b* are poured over the reinforcing bars and insulating material 1530*a* such that rod 530 is immersed in the wet concrete portions 1550*a* and 1550*b* and the wet concrete portions 1550*a* and 1550*b* contacts the thermal break 500. The insulating material 1530*a* is coupled to the portions 1550*a* and 1550*b* using methods known in the art. The portions 1550*a* and 1550*b* set to form the structural wythe 1550.

Referring to FIG. 15(*g*), and prior to the portions 1550*a* and 1550*b* fully setting, an embed (un-numbered) of the structural wythe support structure 1580 is inserted into portion 1550*b* so that portion 1550*b* fully immerses the lugs of the embed (un-numbered) of the structural wythe support structure 1580. Insulating material 1530*b* is positioned over portions 1550*a* and 1550*b* with the end face of the insulating material 1530*b* being contiguous with lumber surface 1200*a*. Preferably, insulating material 1530*b* is positioned over the portions 1550*a* and 1550*b* before the portions 1550*a* and 1550*b* set. Insulating material 1530*b* is coupled to the portion 1550*a* using methods known in the art.

As depicted in FIG. 15(*g*) insulating material 1530*b* is coupled to portion 1550*a* and a portion of the structural wythe support structure 1580, and contiguous with thermal break 500. In another example, insulating material 1530*b* is coupled to portion 1550*a*, portion 1550*b* and a portion of the structural wythe support structure 1580, and contiguous with thermal break 500. As depicted in FIG. 15(*g*), thermal break 500 is contiguous with at least a portion of the structural wythe support structure 1580 (e.g. the panel of the embed). In another example, thermal break 500 is not contiguous with the structural wythe support structure 1580.

When the fascia wythe 1540 and the structural wythe 1550 have set, the formwork is removed.

Exterior Wall Manufacture Using Thermal Break 200—Example 2

Figure 16A:
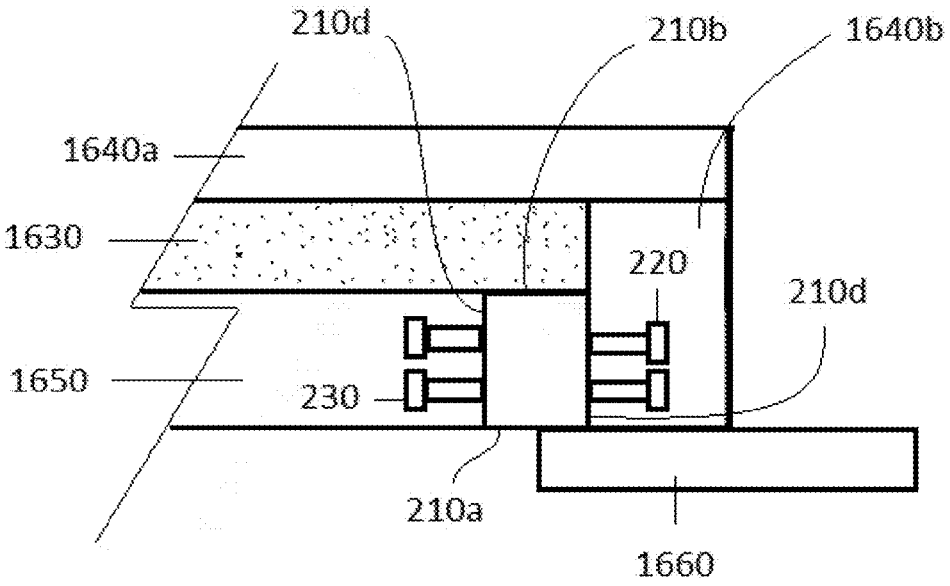
FIGS. 16(*a*) to 16(*c*) relate to a thermal break disposed in an exterior wall according to another embodiment.
Figure 16B:
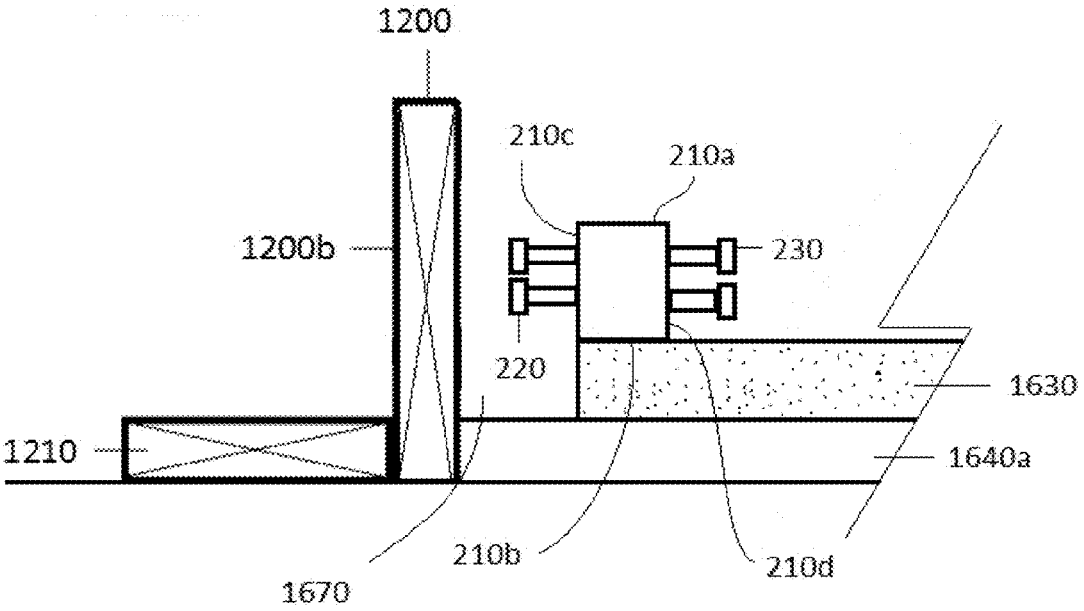
Figure 16C:
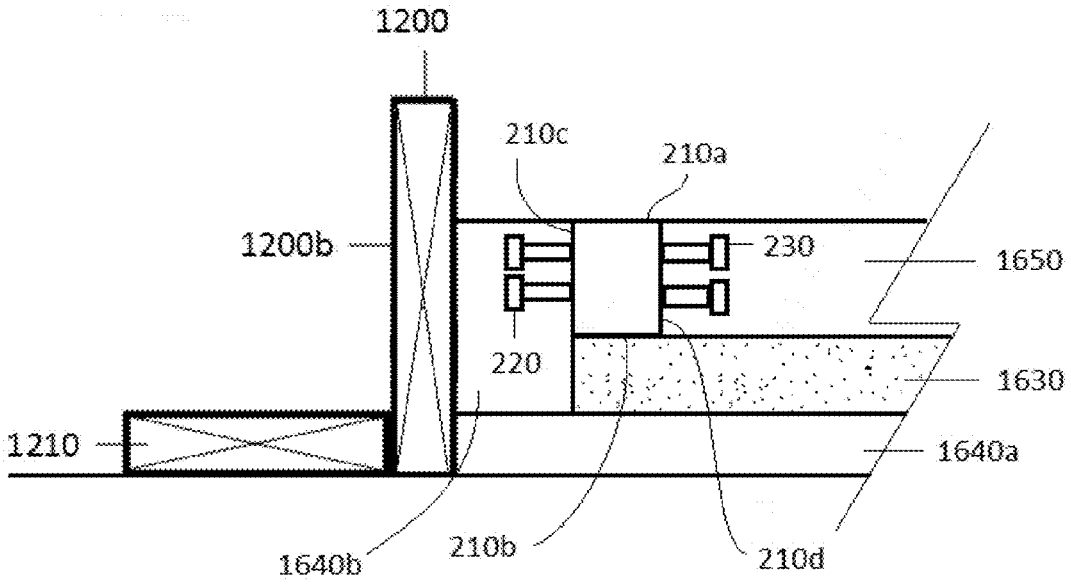
Figure 17A:
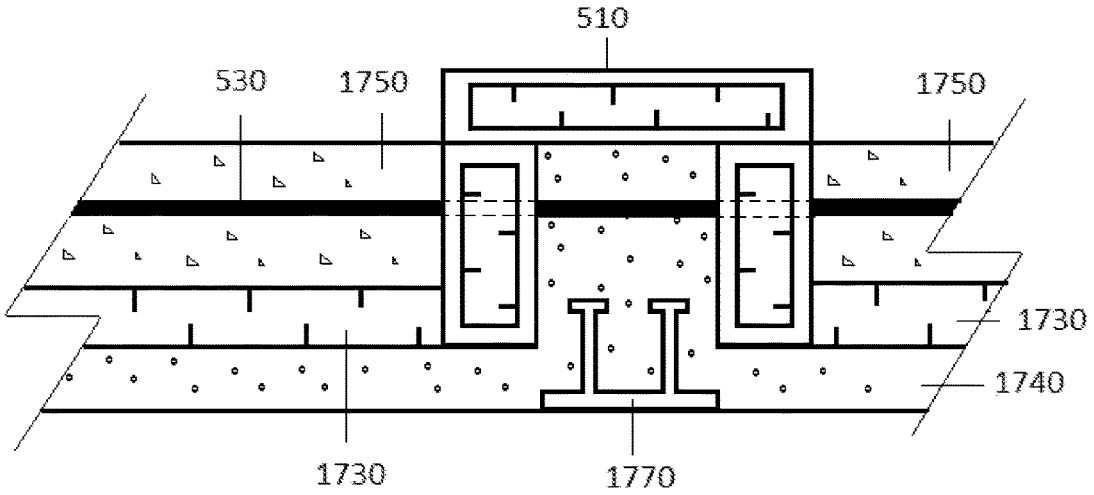
FIGS. 17(*a*) to 17(*e*) relate to a plurality of thermal breaks disposed in an exterior wall according to another embodiment.
Figure 17B:
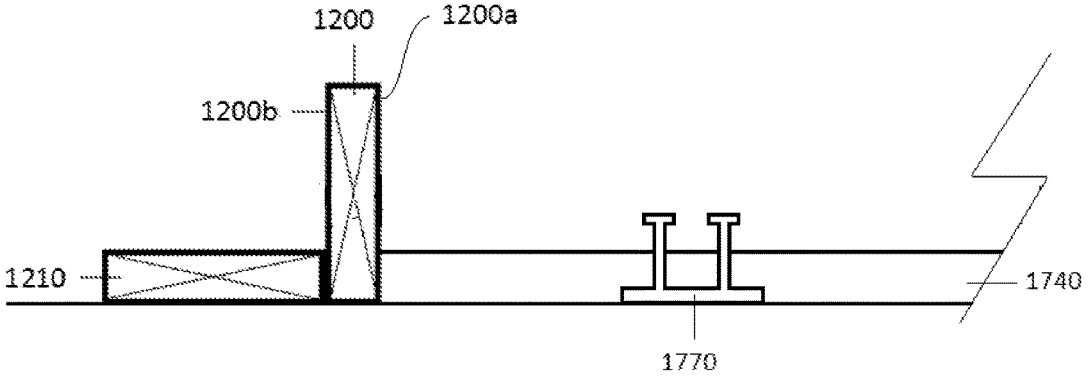
Figure 17C:
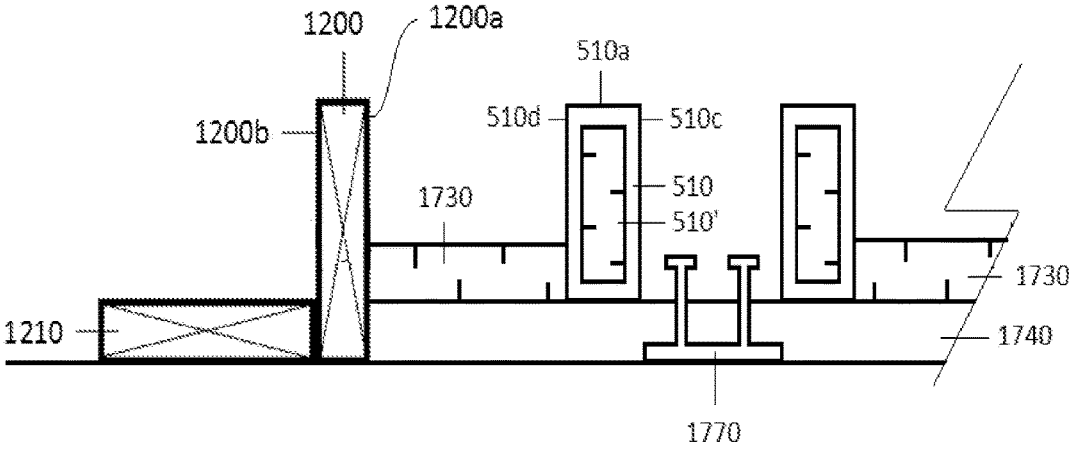
Figure 17D:
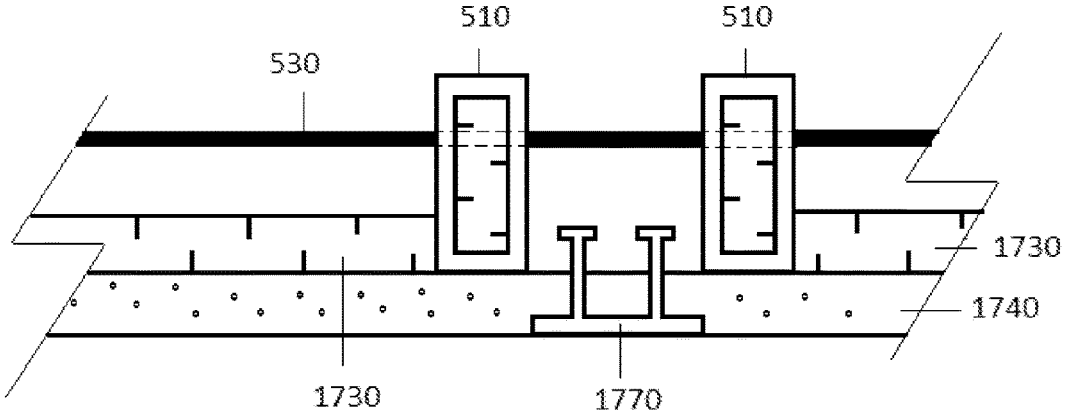
Figure 17E:
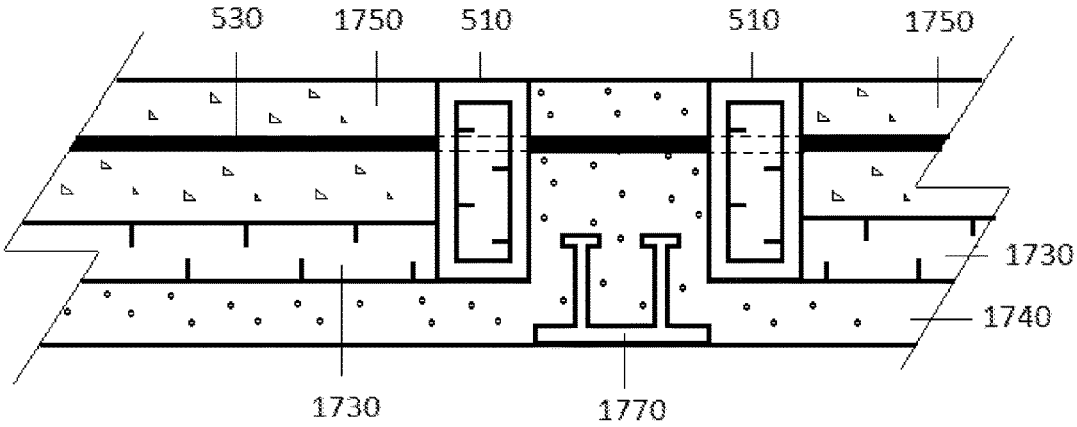

Referring to FIG. 16(*a*), there is an exterior wall 1600 comprising a first fascia wythe 1640*a*, a structural wythe 1650, insulating material 1630 disposed between the first fascia wythe 1640 and the structural wythe 1650, a thermal break 200 contiguous with insulating material 1630 and structural wythe 1650, and a second fascia wythe 1640*b* contiguous with the first fascia wythe 1640*a*, insulating material 1630, and thermal break 200. A fixture 1660 may overlap a surface of the thermal break 200 and a surface of the second fascia wythe 1640*b*, and may be affixed to the thermal break 200. As contemplated herein, the fixture 1660 is an overhead door or another fixture having similar structural requirements as an overhead door.

The exterior wall 1600 disclosed herein provides continuous insulation and a thermal barrier between the structural wythe and the fascia wythe, as required by certain energy codes, and an additional surface (i.e. the surface of the thermal break) for affixing or at least partially supporting a fixture. In present industry standards, this detail is often overlooked or ignored. For example, some overhead door openings currently installed have the insulating material stopping short of the opening, thereby failing to provide continuous insulation between the structural wythe and fascia wythe and consequently failing to meet the requirements of certain energy codes.

Referring to FIG. 16(*b*), a formwork is constructed at the boundary of the pre-defined area as discussed above. Welded wire mesh (not shown) is laid out within the boundaries of the formwork and over the pre-defined area. A first layer of wet concrete (forming the fascia wythe 1640 of the exterior wall) is poured within the pre-defined area and over the welded wire mesh. Preferably, insulating material 1630 is positioned over the first layer of concrete 1640 before the first layer of concrete 1640 sets. The insulating material 1630 is coupled to the first layer of concrete 1640 by methods known in the art. An end face of the insulating material 1630 is positioned a pre-determined distance away from lumber 1200 of the formwork. The insulating material may be of any suitable thickness, for example, 1, 2, 3, 4, 5, 6, 7, 8, 9, 10 inches. As contemplated in this example, insulating material 1630 has a thickness of about 3 inches. The insulating material may have any suitable R-value. As contemplated in this example, insulating material 1630 has an R-value of about 15.

Surface 210*b* of the thermal break 200 is positioned to be contiguous with the insulating material 1630. The body 210 of the thermal break 200 is also positioned a predetermined distance away from lumber 1200 of the formwork. As contemplated in this example, the predetermined distance that the insulating material 1630 is placed away from lumber 1200 of the formwork and the predetermined distance that the body 210 of the thermal break 200 is placed away from lumber 1200 of the formwork are the same. In other examples, the predetermined distance that the insulating material 1630 is placed away from lumber 1200 of the formwork and the predetermined distance that the body 210 of the thermal break 200 is placed away from lumber 1200 of the formwork may be different. Lumber 1200, first fascia wythe 1640*a*, the end surface of insulating material 1630, and surface 210*c* of the thermal break 200 define a spatial volume 1670.

Reinforcing bars (not shown) are laid out over insulating material 1630. Referring to FIG. 16(*c*), a second layer of wet concrete 1650 is poured over the reinforcing bars and insulating material 1630 such that protrusions 230 are immersed in the wet concrete layer 1650 and the wet concrete layer 1650 contacts surface 210*d* of the thermal break 200. The second layer of wet concrete 1650 sets to form the structural wythe 1650. A third layer of wet concrete 1640*b* is poured into spatial volume 1670. The third layer of wet concrete 1640*b* is contiguous with first fascia wythe 1640*a*, the end surface of insulating material 1630, and surface 210*c* of the thermal break 200, and immerses protrusions 220 of the thermal break 200. The third layer of wet concrete 1640*b* sets to form the second fascia wythe 1640*b*.

When the first fascia wythe 1640*a*, the second fascia wythe 1640*b*, and the structural wythe 1650 have set, the formwork is removed, and a fixture 1660, such as but not limited to an insulated overhead door, may be mounted to surface 210*a* of the thermal break 200 or the structural wythe 1650, as depicted in FIG. 16(*a*).

In another example, thermal break 200 is substituted with thermal break 500.

Exterior Wall Manufacture Using a Thermal Break

Presently, at least some embeds are installed in a solid concrete exterior walls without any insulating material in the concrete exterior walls. Such solid concrete structures run afoul of certain energy codes which require exterior walls to have continuous insulating material between the structural wythe and fascia wythe of the exterior wall.

Referring to FIG. 17(*a*), there is an exterior wall 1700 for supporting an embed, the exterior wall 1700 comprising a fascia wythe 1740, a plurality of structural wythes 1750, insulating material 1630 disposed between the fascia wythe 1740 and the plurality of structural wythes 1750, a plurality of thermal breaks disposed between the plurality of structural wythes 1750 and the fascia wythe 1740, and an embed 1770. As contemplated in this example, the plurality of thermal breaks are similar or the same as those described as thermal break 500. The exterior wall 1700 further comprises a rod 530, portions of which are immersed in the plurality of structural wythes 1750, one or more portion of which is immersed in the fascia wythe 1740, and portions of which extend through the bodies 510 of the plurality of thermal breaks 500.

Referring to FIG. 17(*b*), a formwork is constructed at the boundary of the pre-defined area as discussed above. Welded wire mesh (not shown) is laid out within the boundaries of the formwork and over the pre-defined area. One or more embed 1770 is also laid out within the boundaries of the formwork and within the pre-defined area. A first layer of wet concrete 1740 is poured within the pre-defined area and over the welded wire mesh and embed 1770 to a pre-determined height relative to lumber 1200. The first layer of concrete 1740 is allowed to set to form a first portion of the fascia wythe 1740.

Referring to FIG. 17(*c*), a plurality of thermal break bodies 510 are disposed along the first portion of the fascia wythe 1740, such that the surface of each thermal break 500 that is opposite surface 510*a* is contiguous with the first portion of the fascia wythe 1740. Preferably, the thermal break bodies 510 are disposed along the first portion of the fascia wythe 1740 after the first portion of the fascia wythe 1740 has set. As contemplated in this example, thermal break bodies 510 contain insulating material 510'. In other examples, thermal break bodies may or may not contain insulating material. Preferably, insulating material 1730 is disposed over the first portion of the fascia wythe 1740 before the first portion of the fascia wythe 1740 sets. Insulating material 1730 is coupled with first portion of the fascia wythe 1740 using methods known in the art.

Referring to FIG. 17(*d*), rod 530 is passed through the plurality of thermal break bodies 510. Preferably, rod 530 is constructed of an insulating material and non-conducting material such as, but not limited to, fibre-glass, thereby imparting further insulating properties to the exterior wall 1700. Rod 530 serves as the one or more protrusions extending away from a thermal break body 510.

Reinforcing bars (not shown) are laid out over insulating material 1730. Referring to FIG. 17(*e*), wet concrete 1750 is poured over the reinforcing bars and insulating material 1730 such that portions of rod 530 are immersed in the wet concrete 1750 and the wet concrete 1750 contacts surfaces 510*d* of the thermal break bodies 510. The wet concrete 1750 sets to form the plurality of structural wythes 1750. A layer of wet concrete is poured in between surfaces 510*c* of adjacent thermal break bodies 510, thereby immersing the lugs of embed 1770, and the portions of rod 530 in between adjacent thermal break bodies 510. When set, this layer of wet concrete, together with the first portion of the fascia wythe 1740, form the fascia wythe 1740.

In some instances, and to meet certain energy code requirements, an additional thermal break body 510 overlaps the fascia wythe 1750, and is affixed to surfaces 510*a* of adjacent thermal break bodies 510, as depicted in FIG. 17(*a*).

General

The thermal break of the disclosed embodiments may beneficially satisfy energy code requirements that require an insulating material or a thermal break to be present between the structural wythe and fascia wythe at all locations, and at the same time provide a weight-bearing surface for mounting fixtures such as a door frame, window frame, air venting grill, or other building component. The thermal break disclosed herein is less susceptible to rotting over time and is less susceptible to contraction and expansion as compared to wood.

It is contemplated that any part of any aspect or embodiment discussed in this specification may be implemented or combined with any part of any other aspect or embodiment discussed in this specification. While particular embodiments have been described in the foregoing, it is to be understood that other embodiments are possible and are intended to be included herein. It will be clear to any person skilled in the art that modification of and adjustment to the foregoing embodiments, not shown, is possible.

Unless defined otherwise, all technical and scientific terms used herein have the same meaning as is commonly understood by one of ordinary skill in the art to which this invention belongs. Unless otherwise specified, all patents, applications, published applications and other publications referred to herein are incorporated by reference in their entirety. If a definition set forth in this section is contrary to or otherwise inconsistent with a definition set forth in the patents, applications, published applications and other publications that are herein incorporated by reference, the definition set forth in this section prevails over the definition that is incorporated herein by reference. Citation of references herein is not to be construed nor considered as an admission that such references are prior art to the present invention.

What is claimed is:

1. An exterior wall for tilt-up construction comprising:

(a) a fascia wythe of the exterior wall;

(b) a structural wythe of the exterior wall;

(c) a layer of insulating material disposed between the fascia wythe and the structural wythe; and (d) a thermal break in contact with at least the structural wythe, the thermal break comprising an elongate body comprising one or more non-wooden thermal insulating materials, a first surface, a second surface opposite the first surface, a first contacting surface, and a second contacting surface opposite the first contacting surface, the first contacting surface and the second contacting surface extending between the first surface and the second surface; the thermal break further comprising one or more protrusions extending away from at least the second contacting surface; and the structural wythe contacting at least a portion of the second contacting surface, wherein the structural wythe surrounds at least one of the one or more protrusions extending away from at least the second contacting surface.

2. The exterior wall as claimed in claim 1, wherein the second surface contacts the layer of insulating material, and wherein the structural wythe further contacts at least a portion of the first contacting surface.

3. The exterior wall as claimed in claim 1, wherein the layer of insulating material comprises non-weight bearing insulating material.

4. The exterior wall as claimed in claim 1, wherein the layer of insulating material comprises extruded polystyrene insulation.

5. The exterior wall as claimed in claim 1, wherein the layer of insulating material comprises fibre-glass.

6. The exterior wall as claimed in claim 1, wherein the layer of insulating material is non-wooden.

7. The exterior wall as claimed in claim 1, wherein the second surface contacts the layer of insulating material, and wherein at least a portion of the first contacting surface contacts at least a portion of the fascia wythe.

8. The exterior wall as claimed in claim 7, wherein the thermal break further comprises one or more protrusions extending away from the first contacting surface, and the fascia wythe surrounds at least one of the one or more protrusions extending away from the first contacting surface.

9. The exterior wall as claimed in claim 8, wherein the R-value of the layer of insulating material is 15.

10. The exterior wall as claimed in claim 1, wherein the thermal break further comprises one or more protrusions extending away from the first contacting surface, and wherein the fascia wythe contacts the first contacting surface and surrounds at least one of the one or more protrusions extending away from the first contacting surface.

11. The exterior wall as claimed in claim 10, wherein the one or more protrusions extending away from the first contacting surface and the one or more protrusions extending away from the second contacting surface are integrally connected.

12. The exterior wall as claimed in claim 10, wherein at least one of the one or more protrusions extending away from the first contacting surface or the second contacting surface is constructed of a second insulating material.

13. An exterior wall for tilt-up construction comprising:

(a) a fascia wythe of the exterior wall;

(b) a structural wythe of the exterior wall;

(c) a layer of insulating material disposed between the fascia wythe and the structural wythe; and (d) a thermal break in contact with at least the structural wythe, the thermal break comprising an elongate body comprising one or more non-wooden thermal insulating materials, a first surface, a second surface opposite the first surface, a first contacting surface, and a second contacting surface opposite the first contacting surface, the first contacting surface and the second contacting surface extending between the first surface and the second surface; and the structural wythe contacting at least a portion of the second contacting surface, wherein the second surface contacts the layer of insulating material, and wherein the structural wythe further contacts at least a portion of the first contacting surface, and wherein the thermal break further comprises one or more protrusions extending away from the first contacting surface, and the structural wythe surrounds at least one of the one or more protrusions extending away from the first contacting surface.

* * * * *